US005398581A

United States Patent [19]

Castillo

[11] Patent Number: 5,398,581

[45] Date of Patent: Mar. 21, 1995

[54] REVERSIBLE STRINGED INSTRUMENT SYSTEM

[76] Inventor: Carlos Castillo, One Laura Dr., Westbury, N.Y. 11590

[21] Appl. No.: 177,224

[22] Filed: Jan. 4, 1994

Related U.S. Application Data

[63] Continuation-in-part of Ser. No. 767,130, Sep. 27, 1991, Pat. No. 5,275,079, which is a continuation-in-part of Ser. No. 335,607, Apr. 10, 1989, Pat. No. 5,131,307.

[51] Int. Cl.[6] ..... G10D 3/00

[52] U.S. Cl. ..... 84/291; 84/293; 84/267

[58] Field of Search ..... 84/267, 268, 274, 269, 84/275, 291, 292, 293

[56] References Cited

U.S. PATENT DOCUMENTS

| | | | |
|---|---|---|---|
| 692,259 | 9/1867 | Seehausen | 84/306 |
| 1,619,563 | 3/1927 | Burdwise | 84/297 S |
| 1,684,467 | 9/1928 | Boothe . | |
| 1,684,467 | 9/1928 | Boothe | 84/297 R |
| 1,717,677 | 6/1929 | Glasel | 84/297 S |
| 1,870,623 | 8/1932 | Goss et al. | 84/304 |
| 2,260,756 | 10/1941 | Repass | 84/297 R |
| 3,130,625 | 4/1964 | Savona . | |
| 3,251,257 | 5/1966 | Bunker | 84/267 |
| 3,439,570 | 4/1969 | Lee | 84/293 |
| 3,550,496 | 12/1970 | Fender | 84/293 |
| 3,583,272 | 6/1971 | Eurich | 84/267 |
| 3,693,490 | 9/1972 | Raphael | 84/202 |
| 3,834,266 | 9/1974 | Robinson | 84/267 |
| 3,933,077 | 1/1976 | Dunlop | 84/318 |
| 4,078,468 | 3/1978 | Civitello | 84/274 |
| 4,171,660 | 10/1979 | Kingsbury | 84/297 R |
| 4,183,279 | 1/1980 | Shabram, Jr. | 84/318 |
| 4,348,934 | 9/1982 | Ogata | 84/306 |
| 4,359,923 | 11/1982 | Brunet | 84/267 |
| 4,377,963 | 3/1983 | Siminoff | 84/297 R |
| 4,433,603 | 2/1984 | Siminoff | 84/267 X |
| 4,503,747 | 3/1985 | Labbé0 | 84/318 |
| 4,538,497 | 9/1985 | Smith | 84/291 |
| 4,563,934 | 1/1986 | Keizer | 84/318 |
| 4,576,080 | 3/1986 | McLellan et al. | 84/267 |
| 4,648,304 | 3/1987 | Hoshino et al. | 84/313 |
| 4,742,750 | 5/1988 | Storey | 84/313 |
| 4,785,705 | 11/1988 | Patterson | 84/267 |
| 4,793,234 | 12/1988 | Geis | 84/318 |
| 4,953,435 | 9/1990 | Chapman | 84/293 |
| 5,018,423 | 5/1991 | Bunker et al. | 84/293 |
| 5,033,349 | 7/1991 | Nechville | 84/318 |

OTHER PUBLICATIONS

Kuhn et al., *Modern Folk Guitar Method* 281, 303–5 (1984 Alfred A. Knopf, Inc., New York).

*Primary Examiner*—Michael L. Gellner
*Assistant Examiner*—Cassandra C. Spyrou
*Attorney, Agent, or Firm*—Nolte, Nolte, and Hunter

[57] ABSTRACT

A stringed musical instrument system having a body and a reversible neck. The neck is provided with a mounting assembly for selectively alternating the coupling of the neck to the body such that either of the broad surfaces of the body may be utilized as the front surface or back surface of the instrument. The mounting assembly includes a tongue and groove connection between the neck and body. In addition, electrical coupling between the neck and body is provided.

13 Claims, 25 Drawing Sheets

REVERSIBLE STRINGED INSTRUMENT SYSTEM

CONTINUATION-IN-PART

This application is a continuation-in-part of Ser. No. 07/767,130, filed Sept. 27, 1991, to be issued on Jan. 4, 1994, as U.S. Pat. No. 5,275,079, which was a continuation-in-part of Ser. No. 07/335,607, filed Apr. 10, 1989, and issued on Jul. 21, 1992, as U.S. Pat. No. 5,131,307.

The first of those applications was subject to a restriction requirement, and both applications are incorporated by reference in this application.

FIELD OF INVENTION

Capo

The present invention relates to a capo for a guitar, in particular to a capo which rides on a track and may be cammed on and off. In one embodiment, it relates to a capo which can be partially cammed on and off so that some strings are capoed while one or more other strings are not. A second capo can be used to capo the strings not capoed by the first capo.

System

The present invention also relates to the field of stringed instruments and particularly to stringed instruments having a plurality of fingerboards, removably mountable on the body of the instrument for various instrumental configurations.

BACKGROUND OF THE INVENTION

Capo

Guitar players have customarily used a device known as a capo to depress all the strings along a selected fret in order to facilitate the playing of certain chords. Traditionally, such capos have been solid bars held to the fretboard by a strong elastic wrapped from one end off the bar around the neck to the other of the bar.

System

Also, in the stringed instrument art there have been a number of proposals and embodiments of instruments having at least two sets of strings.

Most of these instruments are preconfigured in their construction and, once made, are limited to use in the range and playing style for which they are designed. Furthermore, the construction of each instrument generally favors either a right-handed or left-handed player, or it gives up ergonometric advantages to achieve an ambidextrous configuration.

OBJECT

Capo

It is an object of the present invention to create a more easily moved capo. It is a further object of the present invention to enable faster changes of key by rendering the capo more easily actuated or disengaged. It is a further object of the present invention to allow one or more strings to be left uncapoed while a majority of other strings are capoed.

System

It is a further object to create a stringed instrument system of great flexibility which can have many configurations, some such configurations having great range, particularly suited to modification by use of the cam or partial cam capo.

SUMMARY OF THE INVENTION

Capo

The parent application teaches, among other things, a cam-shaped capo which rides over the fretted surface of the guitar neck. The capo is described therein as substantially a cylinder flattened on a chordal plane having a plurality of circumferential grooves. These grooves retain the strings against lateral displacement under the capo as the strings are plucked and bent. The capo is substantially a cylinder having its axis of rotation eccentrically located in the cylinder so that part of its curved surface is farther from the axis than the most of the curved surface. At the axis is an axle connected by tension members to sliders which ride on track surfaces beneath the fingerboard. By this arrangement, the cylinder forms a cam which can be released by rotating the capo so that part of its curved surface, which is closer to the axis of rotation, is toward the strings, thus releasing the tension and allowing the capo to easily slide along the fingerboard.

A further refinement in this continuation-in-part application, is the creation of one or more sections of the cylinder which are free to rotate independently of the rest of the cylinder.

This refinement allows most of the strings to be capoed while one or more of the strings are not. It permits a creative new style of playing in which the range of the playable notes is extended beyond a range which would be possible were a conventional capo used to capo all the strings across one fret. This enables some new and creative modalities of play not heretofore possible when using a capo.

A second capo may be applied to those strings not depressed by the first capo.

System

This capo is also usable with the system described in the parent application, directed to a stringed instrument system in which the body may be configured with various fingerboards. Each fingerboard is specifically adapted to the sound, range, number of strings and style of playing which is desired at that moment. When the musician desires to change any one or more of these factors, the stringed instrument system of the present invention may be easily reconfigured by changing fingerboards.

In a first embodiment of the present invention, there are two fingerboards. The first fingerboard extends beyond the headward edge of the body and a second fingerboard is located entirely on the body.

Where the fingerboard extends beyond the body, it is provided with a track surface, at each fingerboard edge beyond the headward edge of the body, for mounting a capo. The capo is cam-shaped so that its tension may be applied or removed to the strings by rotating the capo with respect to the fingerboard. When tension is removed, the capo is slidable along the track surface for the entire length of the fingerboard beyond the body.

Where a different configuration is desired, either fingerboard may be removed and rep laced with another interchangeable fingerboard of a different range, different length, and/or different number of strings.

In a further refinement, the body is split between the two fingerboards and pinned at the headward edge of the body along the split so that the two sections of the body are pivotably with respect to each other so that their longitudinal axes may be pivoted slightly out of parallel with each other. Such angling of the fingerboards renders them more compatible with the geometry of the respective hands which are playing them.

Furthermore, the pin may be removable. When the pin is removed, the body sections can be separated from each other and replaced with a body section having no fingerboard. Thus, the instrument may be played as a single guitar, or even as two single guitars.

To facilitate removability from the fingerboards and to render the fingerboards sufficiently strong to be handled when separated from the body, each fingerboard is provided with a reinforcing section located behind the fingerboard. On this reinforcing section is located a mounting track for slidable mounting of the fingerboard to the body. This track is so configured that the structural means for reinforcing the fingerboard are mounted entirely behind the front surface of the body. The mounting means is symmetrical from front to back so that the fingerboard may be removed, turned 180° with respect to the body and oriented so that what had been the back surface of the body is now the front surface of the body. Thus, the instrument may be easily configured either for left-handed or right-handed playing.

The fingerboard may be locked in place on the body in part by means of pins which also serve as conventional electrical connectors for connecting microphone pick-ups and controls of the fingerboard to the circuitry of the body.

In some of the fingerboards, the tuning mechanisms may be located on the bodyward end of the fingerboard. These tuning machines may be mounted on a cassette which is removably mounted to the fingerboard. The geometry of such fingerboards may favor a specially constructed bridge.

The bridges mentioned above may be disposed tailward of one or more of the machine means in order to provide additional string length without extending the neck unduly. In configurations of particularly long necks, it may be desirable to provide extenders so that standard size strings may be used over the extraordinarily long fingerboard. The location of the tuning mechanism in the area of the body, rather than in the area of the head, is unusual in a stringed instrument.

However, owing to the great flexibility of this system, a fingerboard assembly may be provided with a tuner on the head.

In electric guitar configurations, the pick-up microphone may be disposed in a removable mike box for removably mounting on the cassette.

BRIEF DESCRIPTION OF THE DRAWINGS

System

Partial Cam Capo

Figure 21:
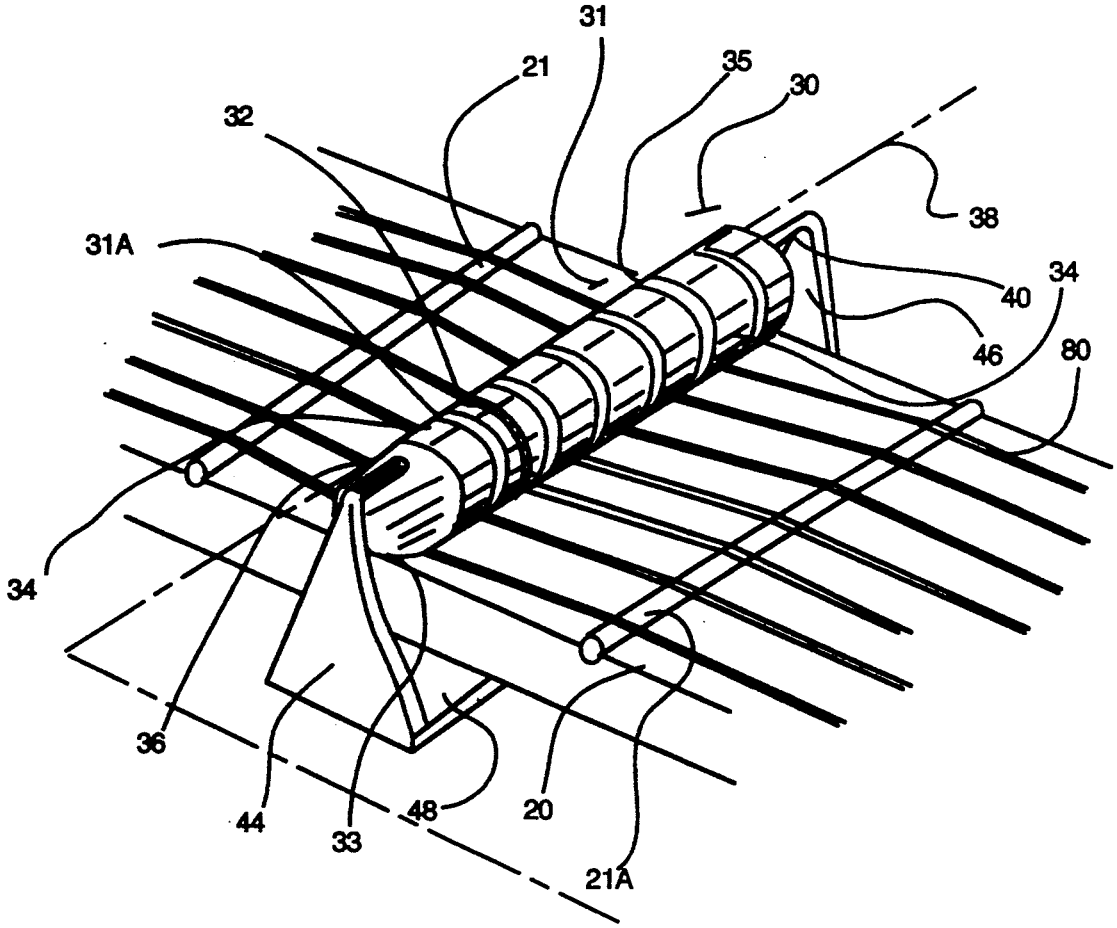

FIG. 21 is an oblique view of a capo of the present invention, mounted upon a guitar neck, and with all sections rotated together to depress all strings on to the fretboard.

Figure 22:
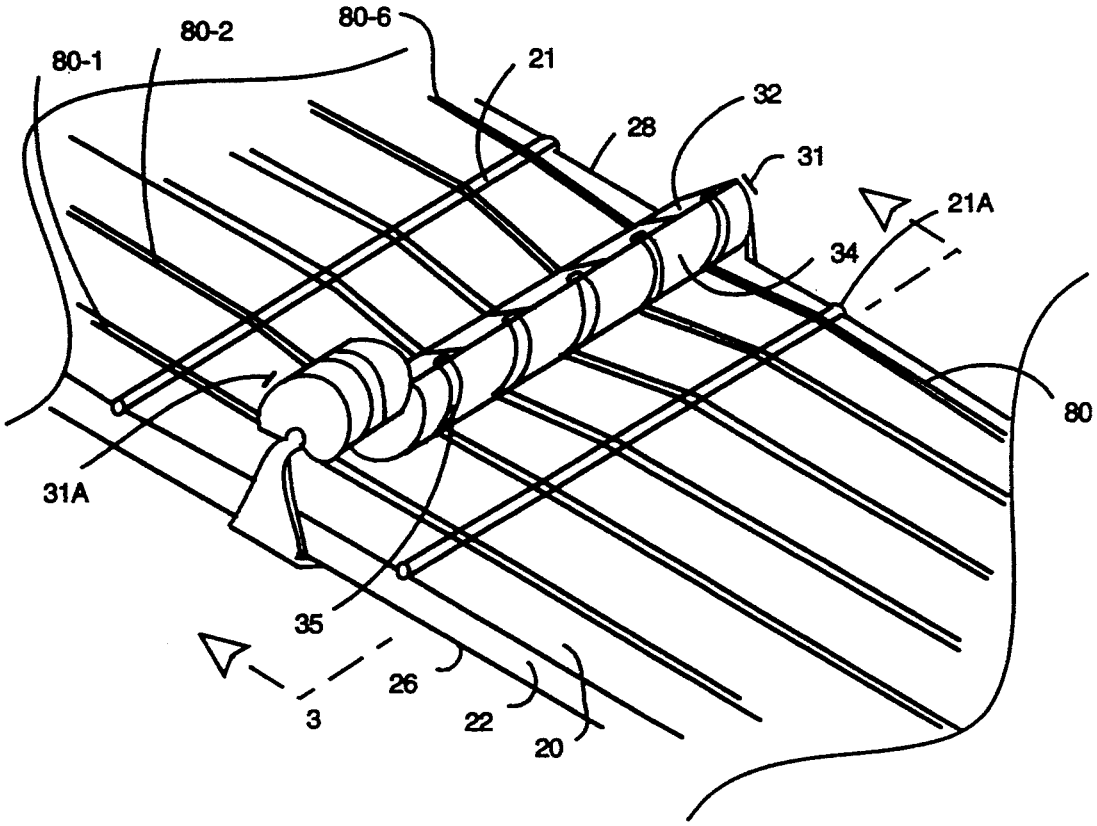

FIG. 22 is a similar view of the present invention in which one section of the capo has been independently rotated to allow its respective guitar string to vibrate freely.

Figure 2:
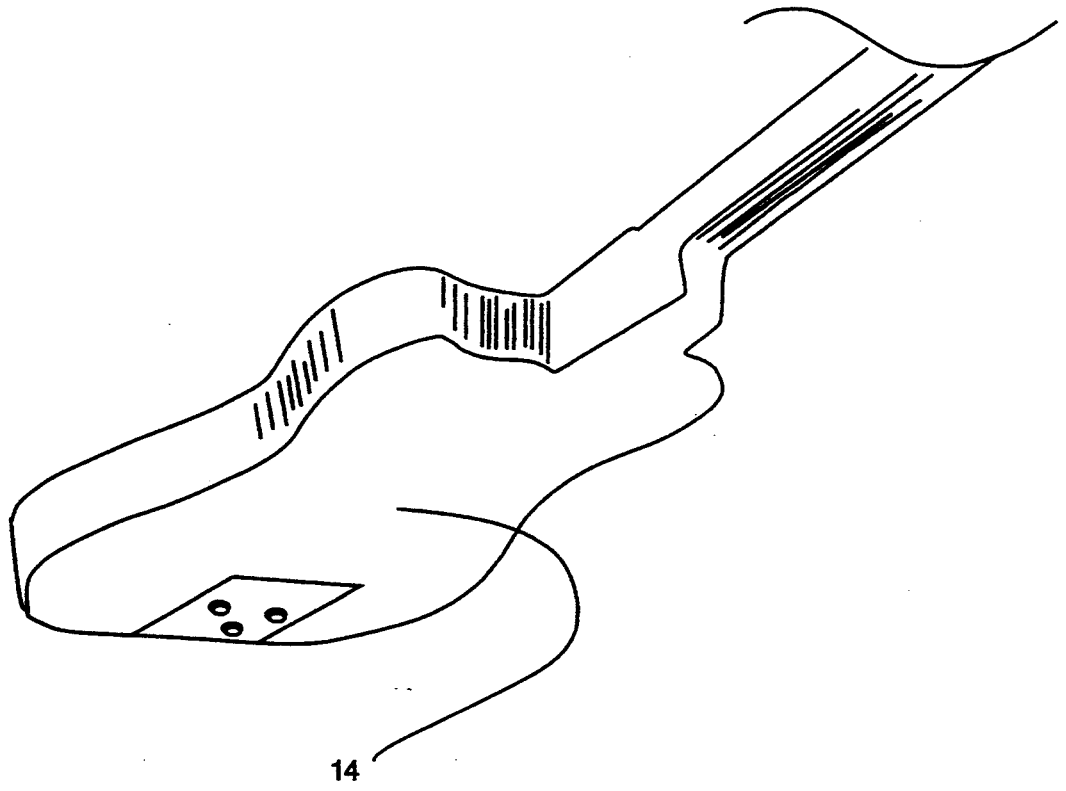
FIG. 2 is a perspective view of the back thereof.
Figure 23:
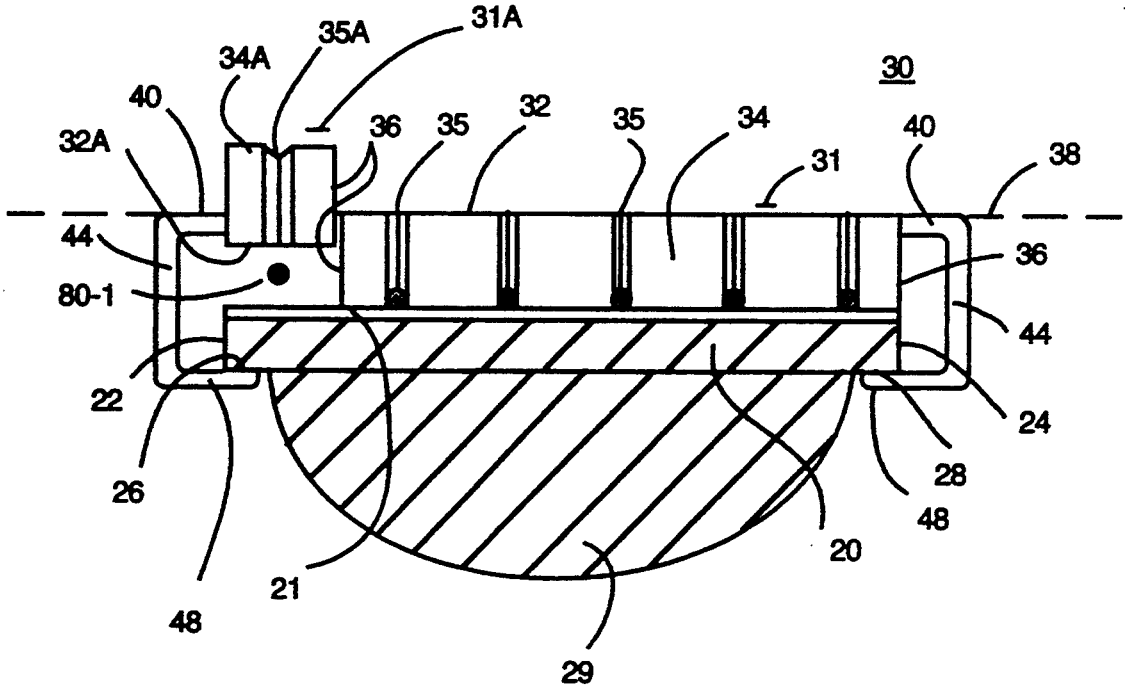

FIG. 23 is a cross-section taken through the plane indicated by line 3 in FIG. 2.

Figure 24:
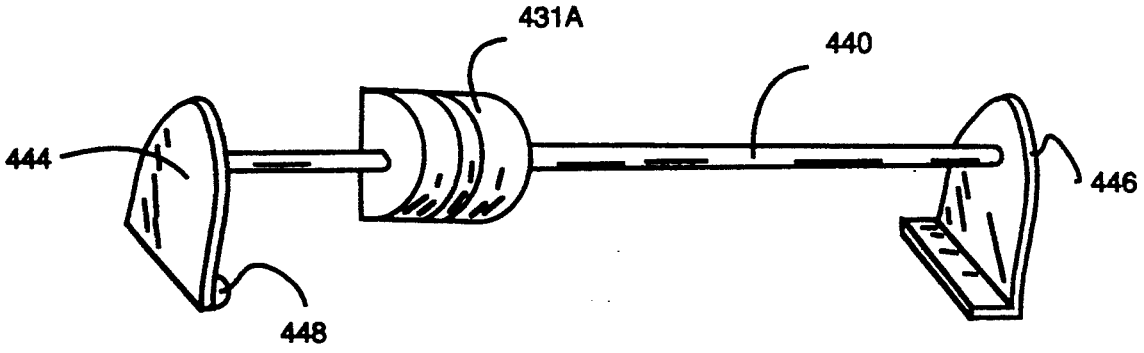

FIG. 24 is an oblique view of a second cam capo.

Figure 25:
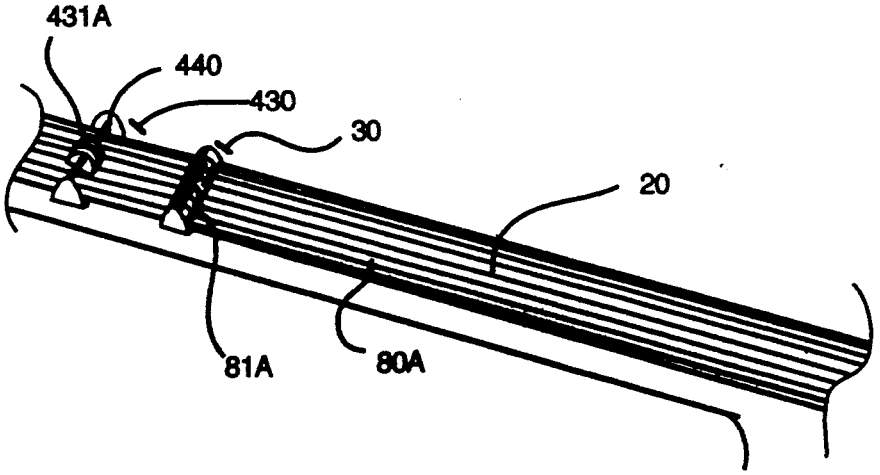

FIG. 25 is an oblique view of a first and second cam capo on a fingerboard.

Figure 26:
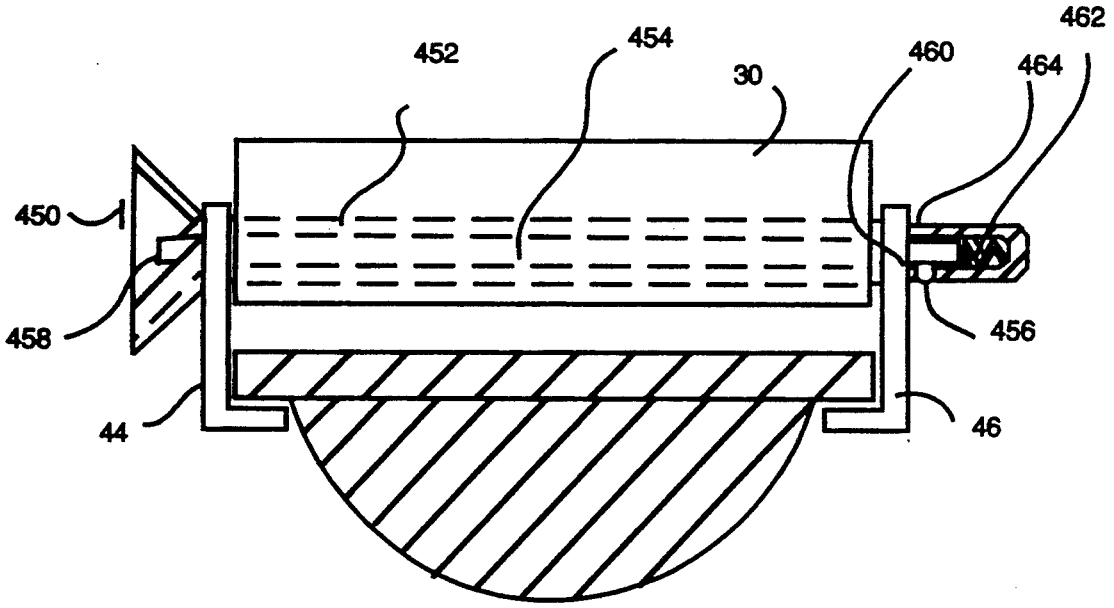

FIG. 26 is another elevation of a capo embodiment, showing a fastpin partially in section.

Figure 27:
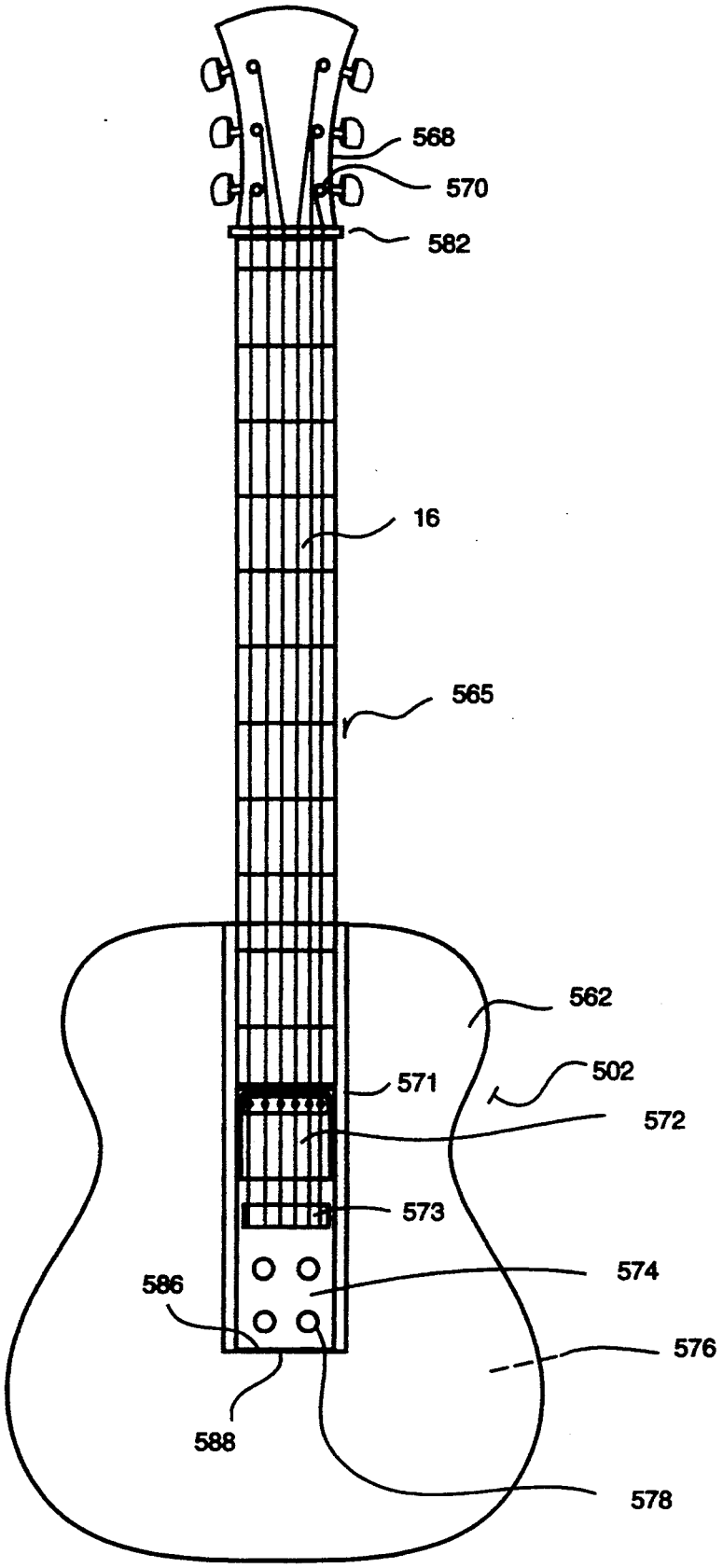

FIG. 27 is a front elevation of a single-neck reversible symmetrical ambidextrous guitar.

Figure 28:
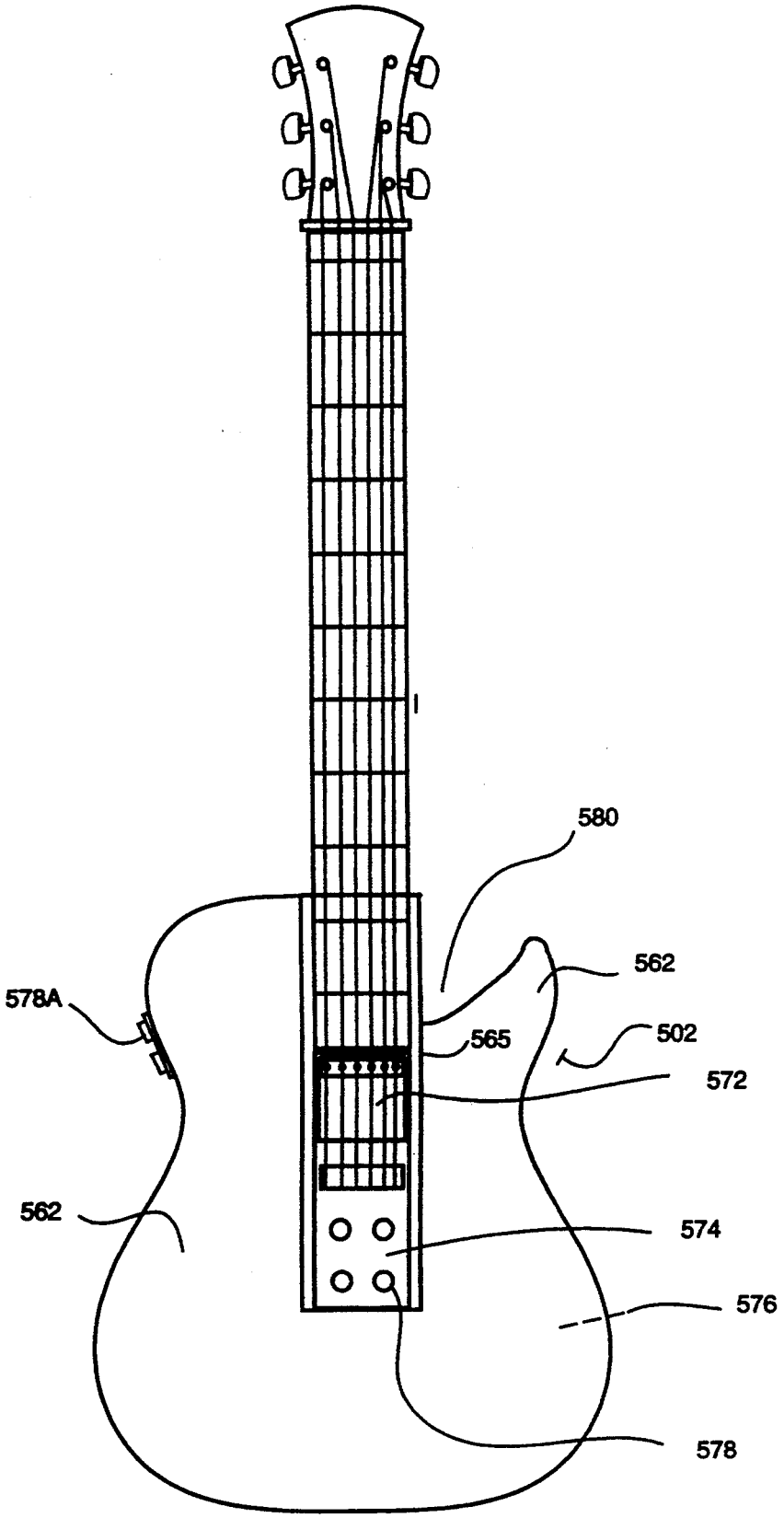

FIG. 28 is a similar view of an asymmetrical embodiment of a reversible ambidextrous guitar, in a configuration for a right-handed player.

Figure 29:
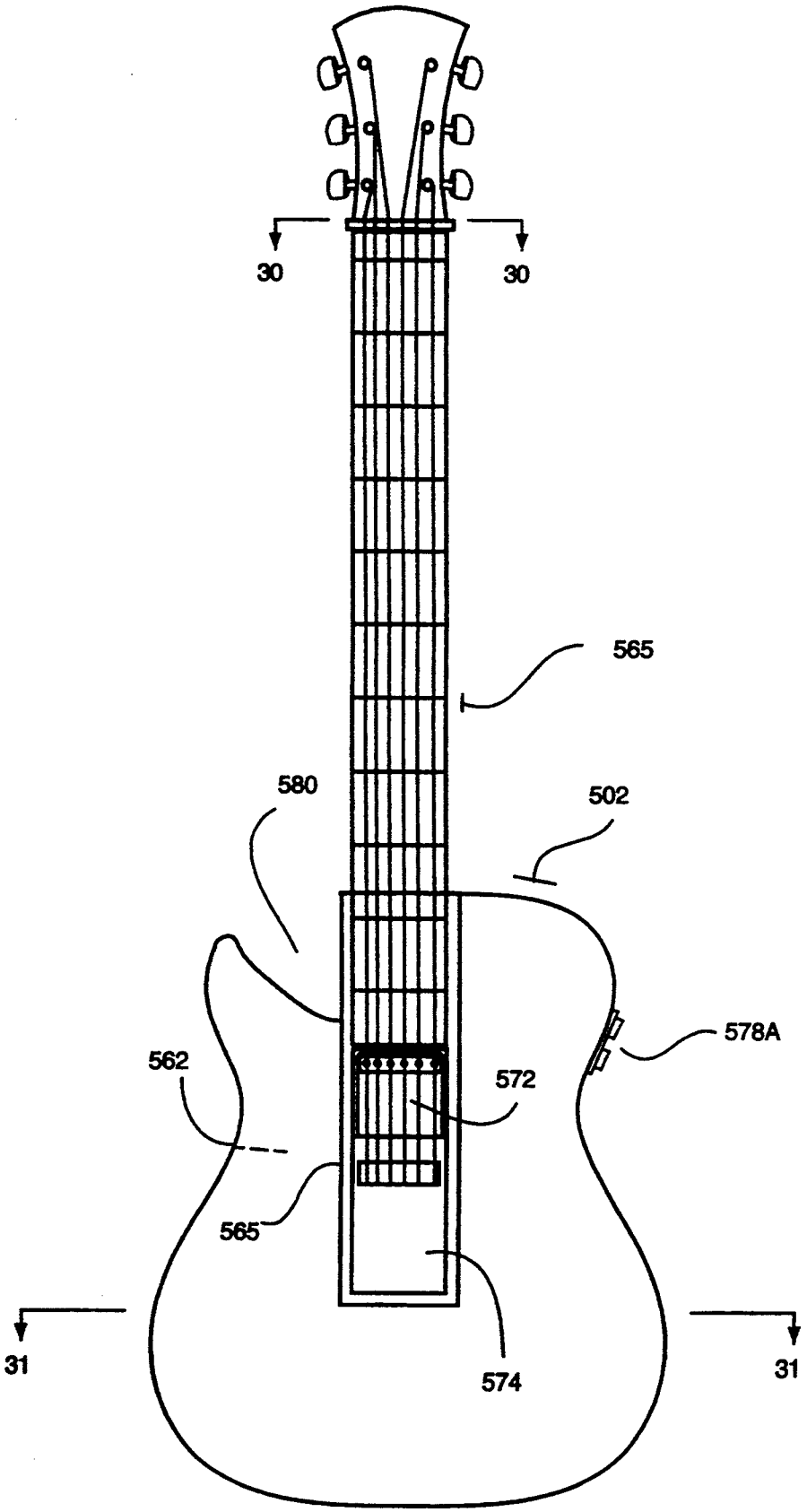

FIG. 29 is a similar view of the guitar shown in FIG. 28, but reversed into a configuration for a left handed player.

Figure 30:
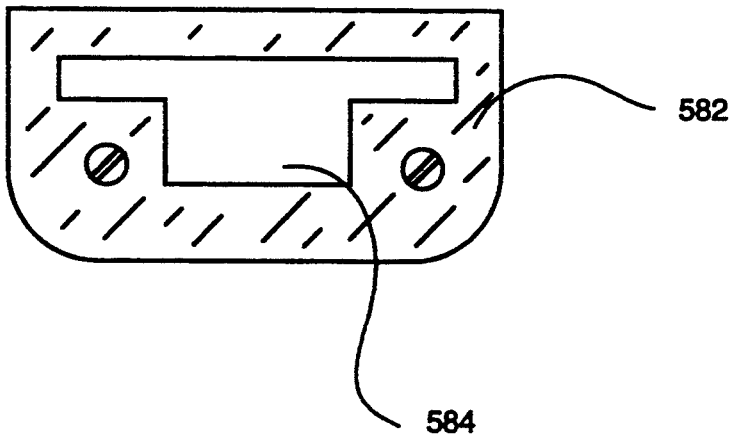

FIG. 30 is a view from the headward end of a guitar such as shown in FIG. 29, with the head piece removed, said view through the plane indicated in FIG. 29, and showing an aluminum reinforcing plate on the fingerboard assembly.

Figure 31:
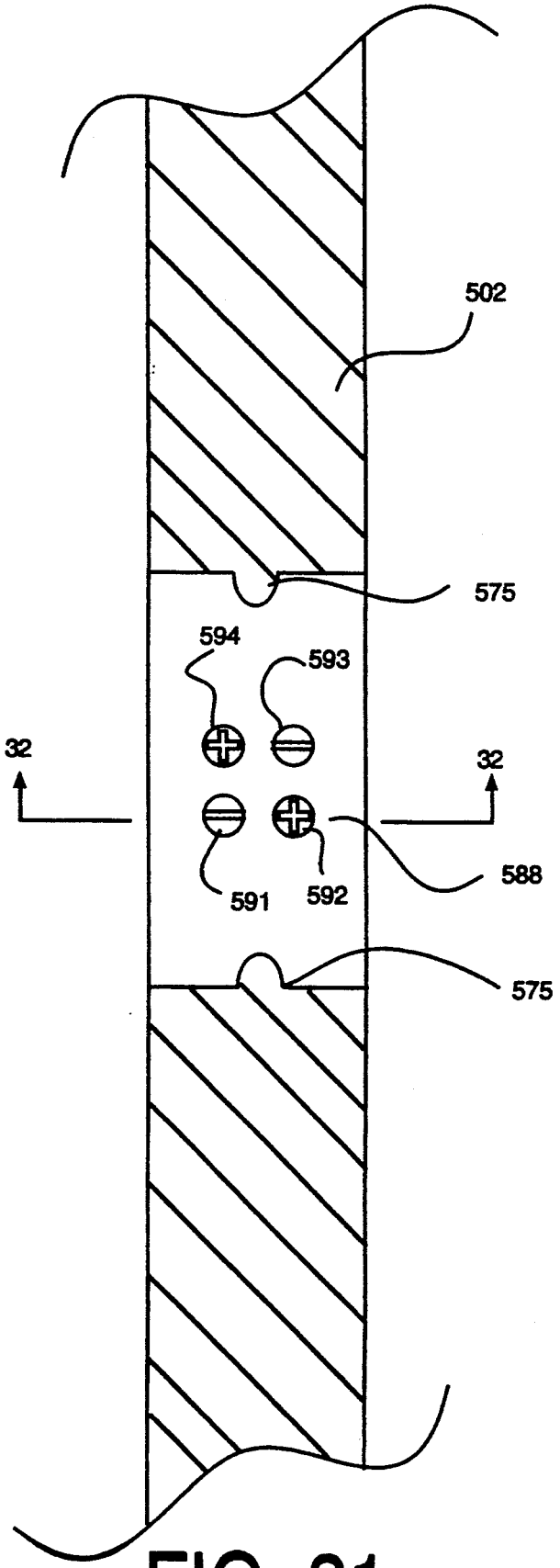

FIG. 31 is an elevation in section through a plane indicated in FIG. 29, but with a fingerboard assembly 565 removed to show a tailward inner wall of the body.

Figure 32:
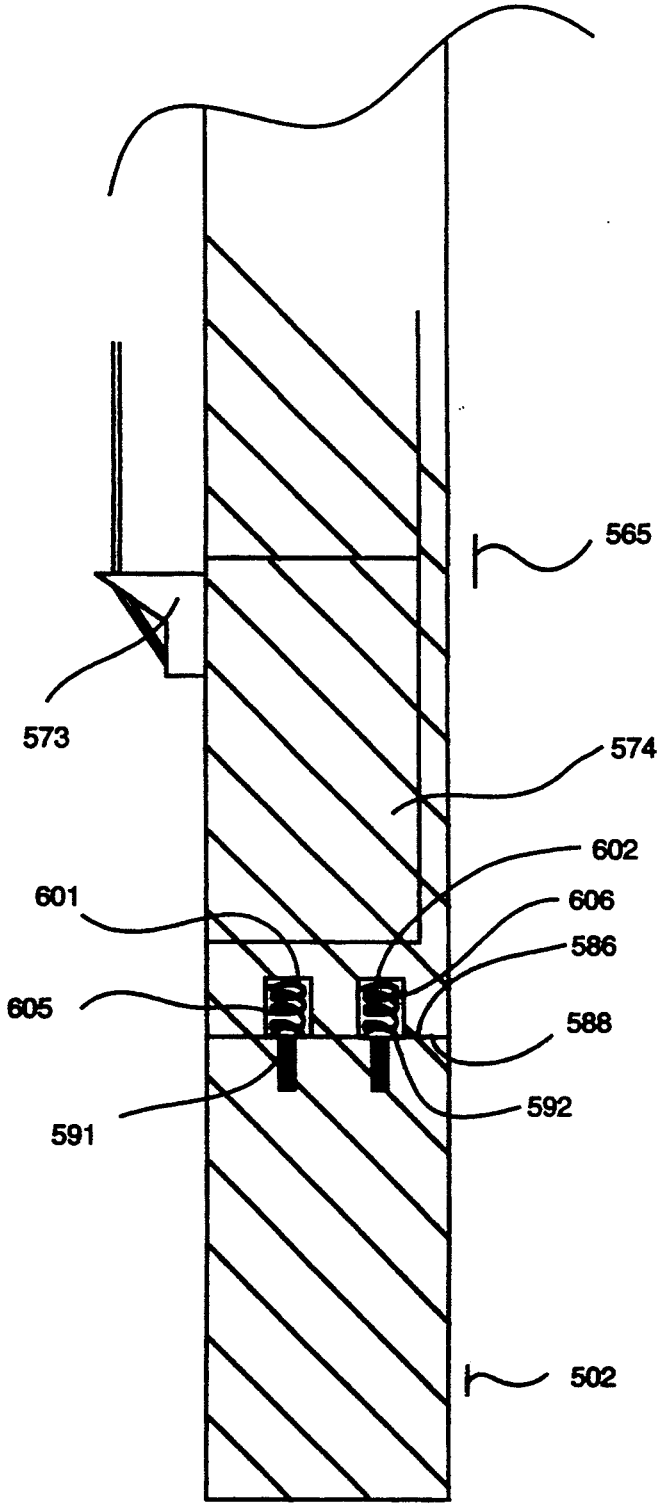

FIG. 32 an elevation in-partial section taken through the plane indicated in FIG. 31, and showing the contact assembly between body 502, and finger board assembly 65.

DETAILED DESCRIPTION OF THE DRAWINGS

System

Figure 1:
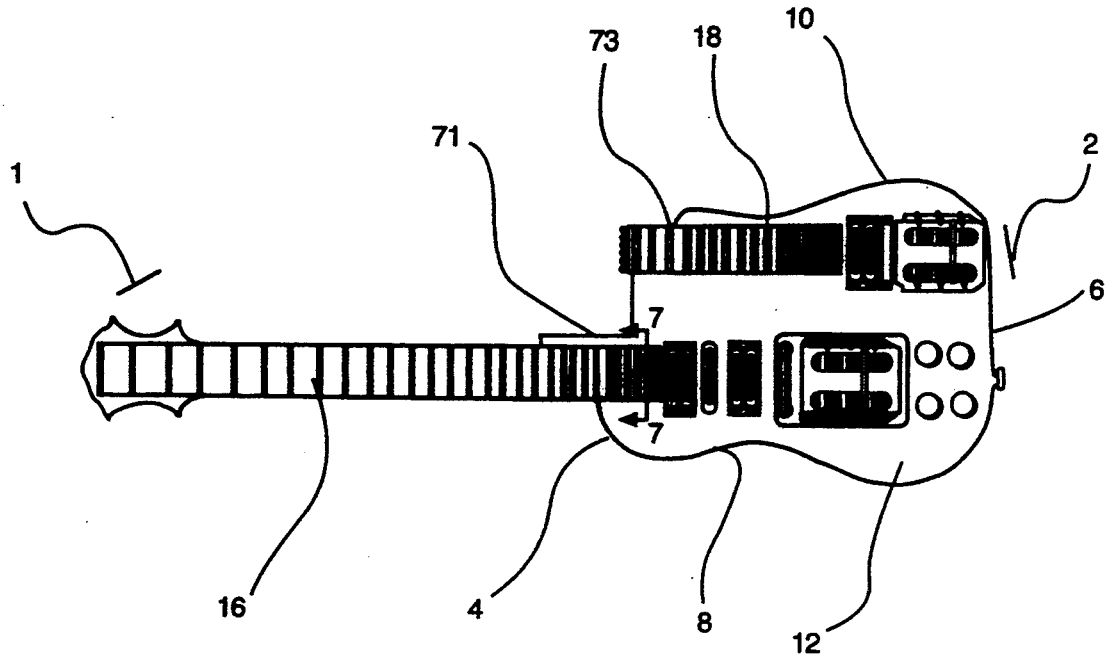
FIG. 1 is a front elevation of a guitar embodying the stringed instrument system of the present invention.
Figure 3:
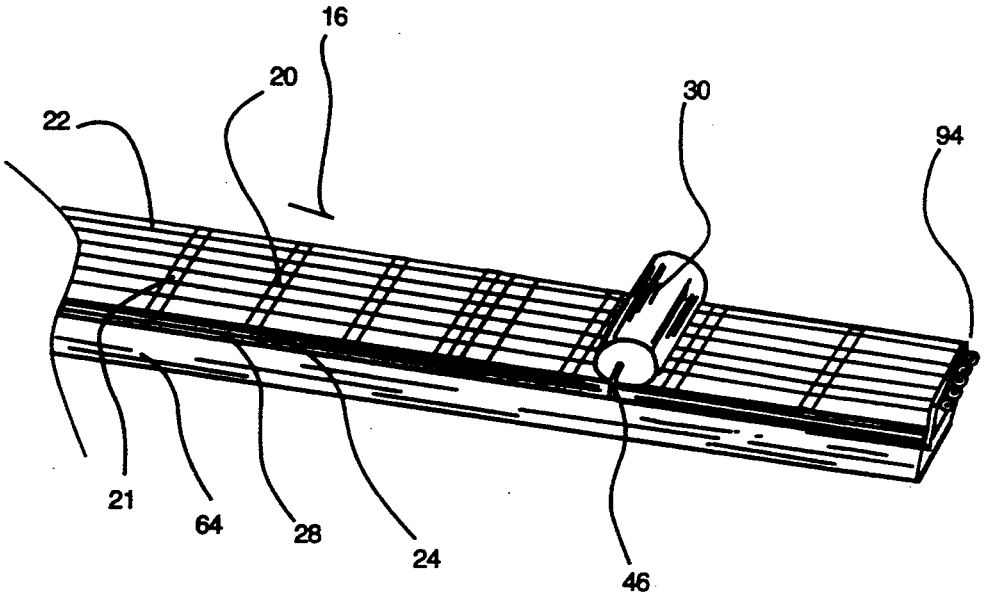
FIG. 3 is a perspective view showing a neck thereof comprising the first fingerboard.

Turning now to the drawings we can see various configurations of various embodiments of the present invention. FIG. 1 shows a two-fingerboard guitar of the stringed instrument system of the present invention. The guitar, generally designated 1, comprises a body 2. The body has a headward edge 4, a tailward edge 6, an upper edge 8 and a lower edge 10. It also has a front surface 12 and a back surface 14 shown in FIG. 2. Returning to FIG. 1, a first fingerboard 16 extends beyond the headward edge 4 of body 2. Second fingerboard 18 is located entirely on the body 2. That is, it is located within the confines of headward edge 4 and tailward edge 6, and does not extend beyond the edges. As shown in FIG. 3, the first fingerboard 16 comprises a fretted surface 20, frets 21, upper edge 22, located at the upper edge of fretted surface 20, and lower edge 24, located at the lower edge of the fretted surface. As in FIG. 4, fingerboard 16 overhangs reinforcing structure 64 so that undersurface 26 of edge 22 provides a track surface, as does the corresponding undersurface 28 of edge 24 shown in FIG. 3.

Capo

Figure 4:
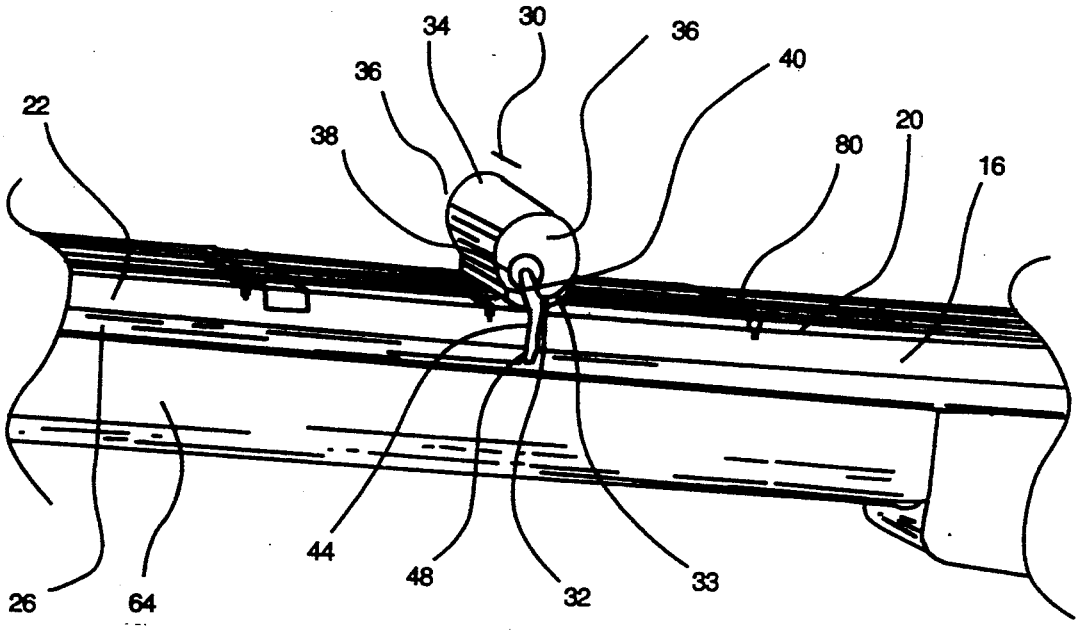
FIG. 4 is a perspective view showing a cam capo mounted upon the fingerboard.
Figure 18:
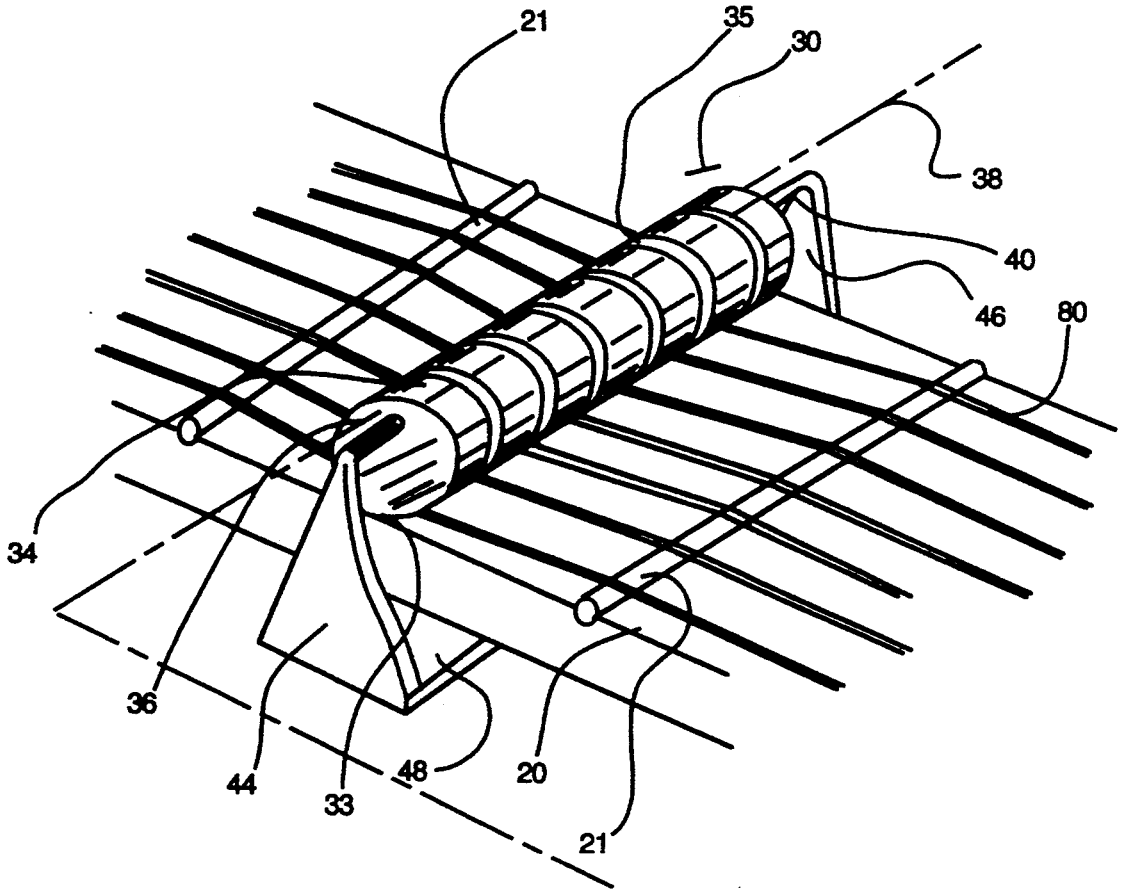
FIG. 18 is a perspective view of a cap.

A capo 30 is provided which rides on the fretted surface 20. Although FIG. 4 shows capo 30 as comprising flat surface 32 on which is mounted felt pad 33, this is not the presently preferred embodiment of the capo. In the preferred embodiment, shown in FIGS. 7 and 18, capo 30 is a cylinder having a plurality of circumferential grooves 35. These grooves 35 retain the strings 80 against lateral displacement under the capo as the strings are plucked and bent. "Lateral" here means: in the plane of the fretboard transverse to the length of the strings. Such lateral displacement would cause an ungrooved capo to frictionally retain the strings at an unanticipated tension and lateral position, causing the strings to be hard to find, hard to depress alone, and out of tune. Capo 30 depresses strings 80 at the location of the desired fret. The capo is generally substantially a cylinder having curved surface 34 and a pair of sides 36 as the cylinder bases. As in FIG. 18, axis of rotation 38 for cylindrical capo 30 is parallel to curved surface 34, and frets 21 of fretted surface 20. Axis 37 is eccentrically located in the cylinder so that part of its curved surface 33 is farther from the axis than most of curved surface 34. Pin 40 is the axle at axis of rotation 38 around which capo 30 rotates. Tension members 44, 46 extend from the axle of pin 40 to sliders 48 which ride on track surfaces 26, 28 of the fingerboard. By this arrangement, the cam can be released by rotating the capo so that the part of its curved surface 34 which is closer to axis of rotation 38 is towards the strings. This configuration releases the tension of tension members 44, 46 and allows capo 30 to be easily slid headward and tailward on the fingerboard of the guitar. Rotating the more distant, from the axis, surface 33 toward the fingerboard, cams pin 40 away from the fingerboard and exerts tension through tension members 44, 46 (FIGS. 18, 3 and 4) on slider 48. This causes the capo to be depressed upon strings 80 and to pin the strings to the nearest fret, thus capoing the guitar. Provision may also be made for a similar capo system on second fingerboard 18.

It is aesthetically desirable to taper edges 22, 24 (FIGS. 3 & 4) of fingerboard 16 towards the head. Therefore, the surfaces 27 of reinforcing structure 64 adjacent track surfaces 26, 28, should be kept parallel to each other in order to properly guide sliders 48 along track surfaces 26, 28.

Additionally, pin 40 and sliders 48 should extend out far enough from edges 22, 24 to allow tension members 44, 46 to clear edges 22, 24 along the entire length of edges 22, 24.

Partial Cam Capo

FIG. 21 shows the fretted surface 20 of the guitar fingerboard upon which reside frets 21, 21A. When the guitar neck is held in the left hand as is normal For a right-handed player, edge 22 of the fretted surface becomes the upper edge of the fretted surface.

Turning now to FIG. 23, we see that the capo, generally designated 30, resides upon fretted surface 20 over neck 29 and is held in place there by a reactive force against upper track surface 26 and lower track surface 28. Returning to FIG. 21, the capo 30 has a flattened surface 32 which provides a grip with which the guitar player may more easily rotate the capo to cam it on or off. Said surface, being located most closely to the axis of rotation of the capo, provides improved clearance for the guitar strings 80 when they are not being capoed on. Curved surface 34 is opposite flat surface 32. Curved surface 34, being farther from the axis of rotation 38 of the capo, will, when rotated toward strings 80, depress strings 80 across fret 21A on to fingerboard or fretboard 20 so that the maximum undamped length of each string 80 terminates at fret 21A as shown. Curved surface 34 of the capo comprises a plurality of grooves 35 corresponding to the desired crosswise location of the guitar strings. Absent these grooves, the manipulated guitar strings could slide beneath the capo in a direction across the longitudinal axis of the fretboard and would then be held away from each string's natural center line until such time as vibration or friction or mechanical force from fingering were to bring it back to its natural location. This would result in stretch and creeping of the guitar strings and the tension thereon. Such stretch, creeping, and changes in string tension would result in inconsistent resonant frequencies of the strings which would change unpredictably and render playing in-tune very difficult. Grooves 35 hold the strings 80 in their desired location and thereby obviate the difficulties described above.

Capo 30, which is, in shape, basically a pair of cylinders 31, 31A each flattened on one side of its cylindrical wall, comprises cylindrical bases consisting of sides 36.

The axis of rotation 38 passes through these sides 36 and the capo sections 31, 31A rotate eccentrically about a pin 40 provided at axis of rotation 38. Pin 40 is rigidly affixed to tension members 44, 46 which couple pin 40 to sliders 48. FIG. 22 shows the two sections 31, 31A of the capo rotated out of phase with each other. Section 31A has been rotated to relieve pressure upon its respective string 80-1 while section 31 has been rotated to apply pressure to its five respective strings 80-2 through 80-6. FIG. 3 shows string 80-1 suspended between head and bridge and free to vibrate clear of flat surface 32A of capo section 31A. Meanwhile, section 31 has been rotated so that each of the strings 80-2 through 80-6 are restrained by curved surface 34 of capo section 31 and depressed over fret 21A, as shown in FIG. 22.

Section 31A may, of course, be more than one string wide, for separately capoing two or more strings, but the preferred embodiment envisions a single string capoed by section 31A. Likewise, there could be more than two separately rotatable capo body sections.

Second Capo

As shown in FIGS. 24, 25, a second cam capo 430, preferably comprises a cam section 431A, on an axle 440. Axle 440 is mounted on tension members 444, 446. Cam section 431A can be slid along axle 440 and rotated to depress string 80-1 which has been left free by capo 30 section 31A. This arrangement allows full simultaneous capo control over a plurality of string lengths.

Two Body Sections

Turning now from FIGS. 3 and 4 to FIGS. 5 and 6, we perceive the split body sections of the guitar.

Figure 5:
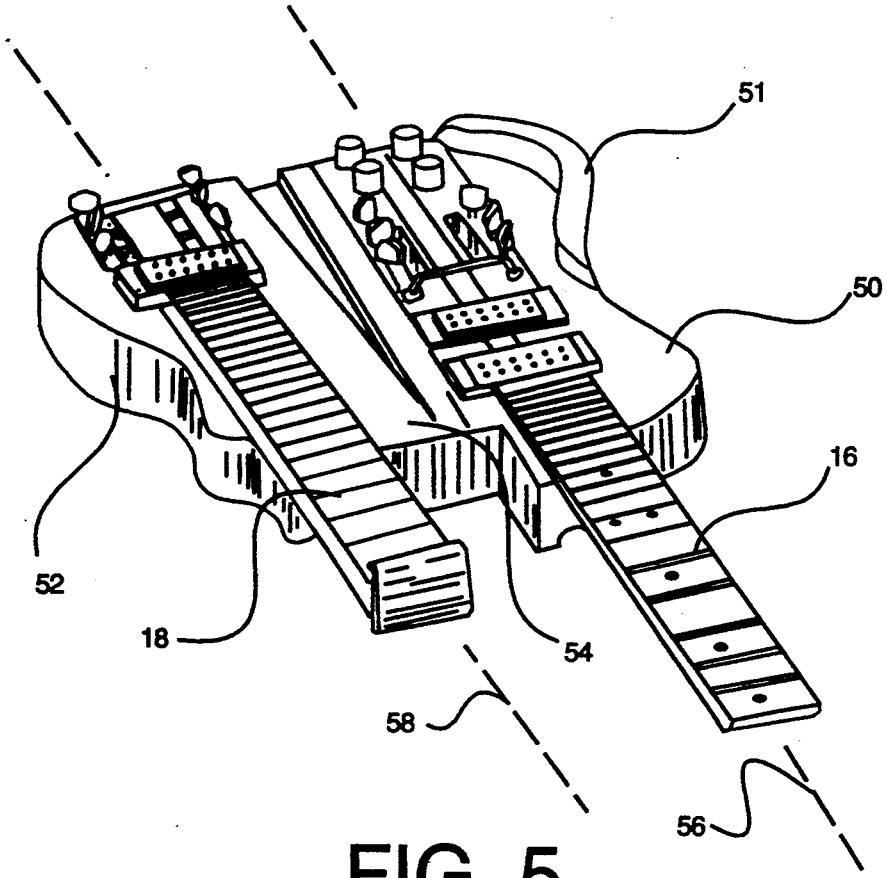
FIG. 5 is a perspective view of another configuration of the present invention.

Upper body section 51 in FIG. 5 compromises first fingerboard 16 and sleeve-guard 51. Sleeve-guard 51 is a raised portion of the body which keeps the sleeve of the right hand, which is playing second fingerboard 18, from resting upon and inadvertently damping strings of first fingerboard 16.

Figure 20:
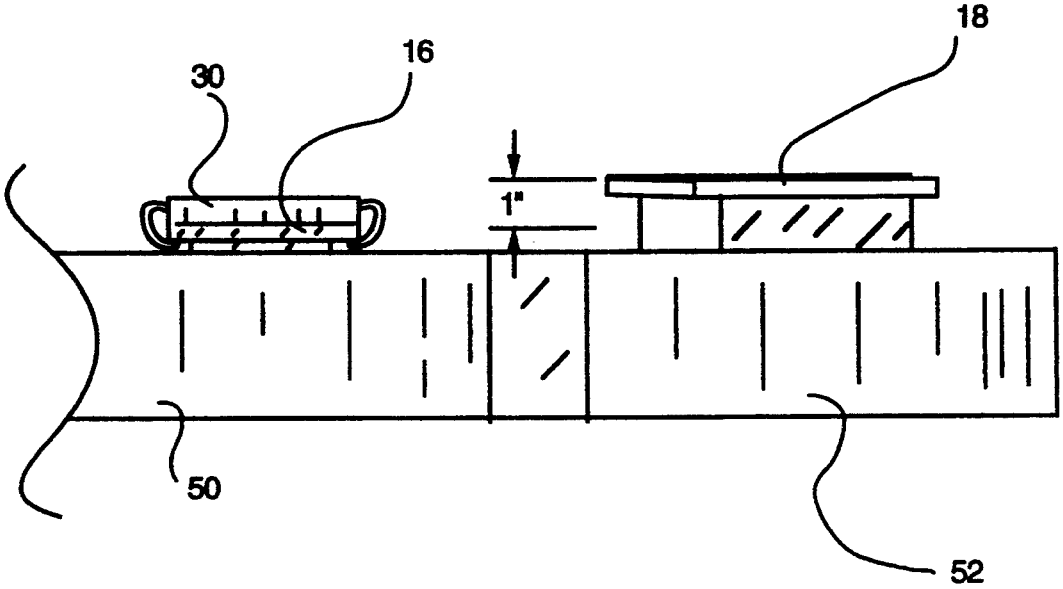
FIG. 20 is an elevation from the tail showing the respective heights of the first and second fingerboards.

Also toward this end, as in FIG. 20, second fingerboard 18 is raised about an inch in front of the plane of the first fingerboard 16. This helps keep the second hand and arm clear of first fingerboard 18.

Lower body section 52 in FIG. 5 comprises second fingerboard 18 which in this embodiment extends beyond the headward edge of the guitar. The two body sections are pivotably pinned by pin 54. Pin 54 allows body section 51 and 52 to pivot so that their longitudinal axes 56 and 58 can be angled slightly out of parallel with each other. This provides a more comfortable angle for both the left hand and the right hand as they finger their respective fingerboards.

As in many electronic guitars, sound will be produced by tapping the strings upon the fretboard rather than by holding such strings down and strumming as is conventional in an acoustic guitar. The geometry of the angled fingerboards makes for more ergonometric fingering of the two boards by their respective hands. If, however, a long extended second fingerboard is installed, the axes 56 and 58 can be kept parallel to each other, in order to maintain clearance space between the fingerboards 16 and 18 for the hand playing first fingerboard 16.

Figure 6:
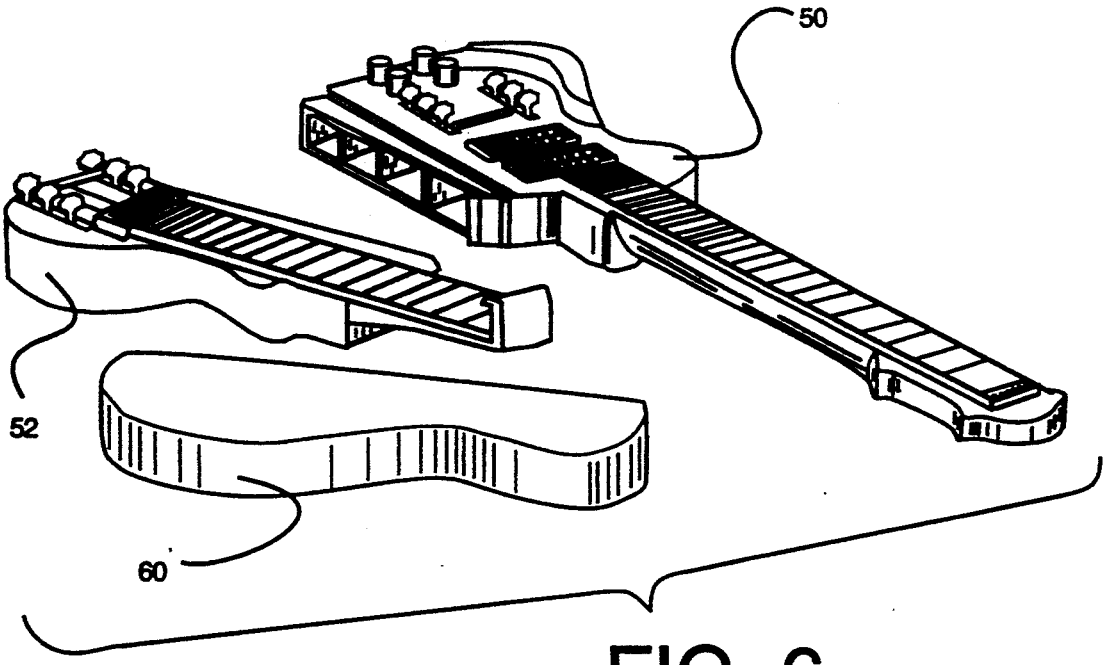
FIG. 6 a perspective view showing various body sections disassembled.

Pin 54 can be removed as shown in FIG. 6 and the first body section 50 and second body section 52 can be separated as shown in FIG. 6. If desired, another body section may be substituted, such as body section 60 which is shown to have no second fingerboard. Thus the guitar can be converted easily from a single-fingerboard guitar to a twin-fingerboard guitar and vise versa.

Interchangeable Fingerboards

Figure 7:
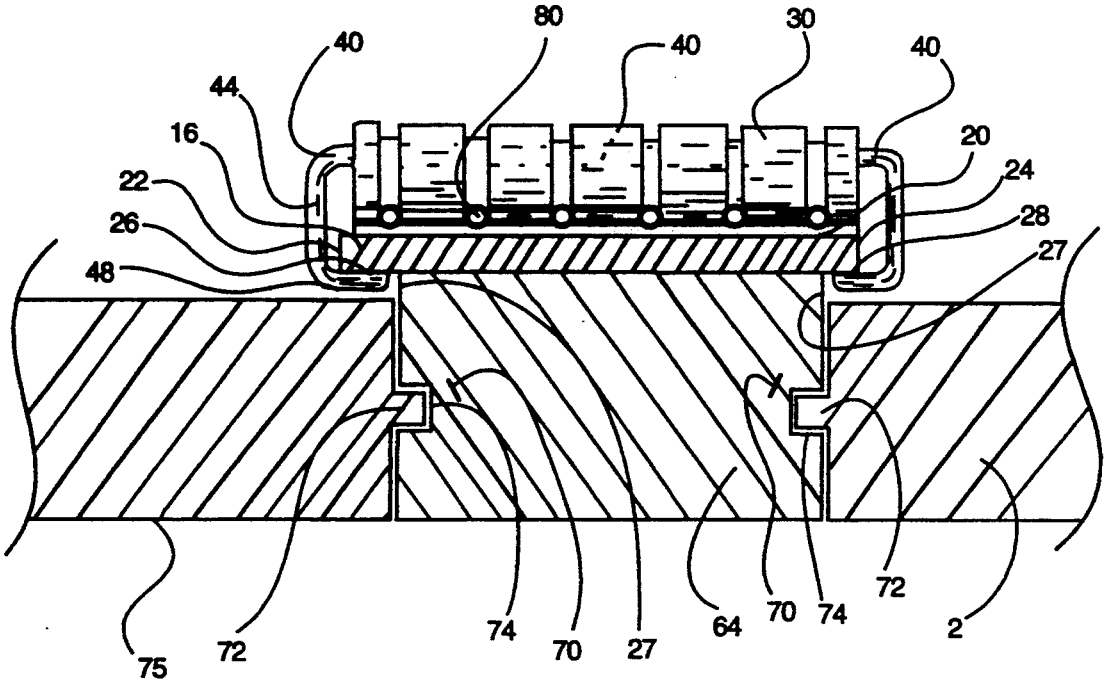
FIG. 7 is an elevation taken in section through the plane labelled 7 in FIG. 1.

Fingerboards 16, 18 may be interchangeably removable and replaceable with other fingerboards having different numbers of strings, different lengths, different tunings, different microphones, and any other characteristics which a performer may wish to vary from song to song or performance to performance. Such conversions can be accomplished in less than one minute. As shown in FIG. 7, body 2 of the guitar has a front surface 62. Fingerboard 16 is backed by fingerboard reinforcing structure 64. As shown in FIG. 7, most of this reinforcing structure 64 is behind the plane formed by front surface 62. Reinforcing structure 64 is largely co-planer with body 2. The mounting means comprises a pair of slide mounts 70. Each slide mount comprises tongue 72 on body 2 and groove 74 on reinforcing structure 64. The slide mounts are located at the sides of reinforcing structure 64 and are centered front to back within body 2 so that the fingerboard assembly may be removed from body 2, rotated about the fingerboard's longitudinal axis 180°, and reinserted into body 2, so that the front surface 62 of the body 2 is now the back surface, and the fingerboard is disposed over old-back/new-front surface 75. Sleeve guard 51 should also be removable so that it can be replaced on the new front side.

Each fingerboard may be completely removed for use alone as a more easily portable solo practice guitar. The practice guitar may be plugged into a specially designed acoustic chamber for use without amplification.

Where the guitar includes this mounting means for both the first and second fingerboards, the guitar can easily be reversed from a right-handed guitar to a left-handed guitar. As will be seen in FIG. 1, cutouts 71, 73 enable the player to move his hands more easily over a greater range of each fingerboard 16, 18. Thus, in the configuration shown in FIG. 1, the guitar is best adapted to a right-handed player. However, reversing the fingerboards will render the guitar better adapted for left-handed playing by placing these cutouts 71, 73 in a position better suited to left-handed fingering.

FIG. 7 also shows another view of cam capo 30.

Figure 8:
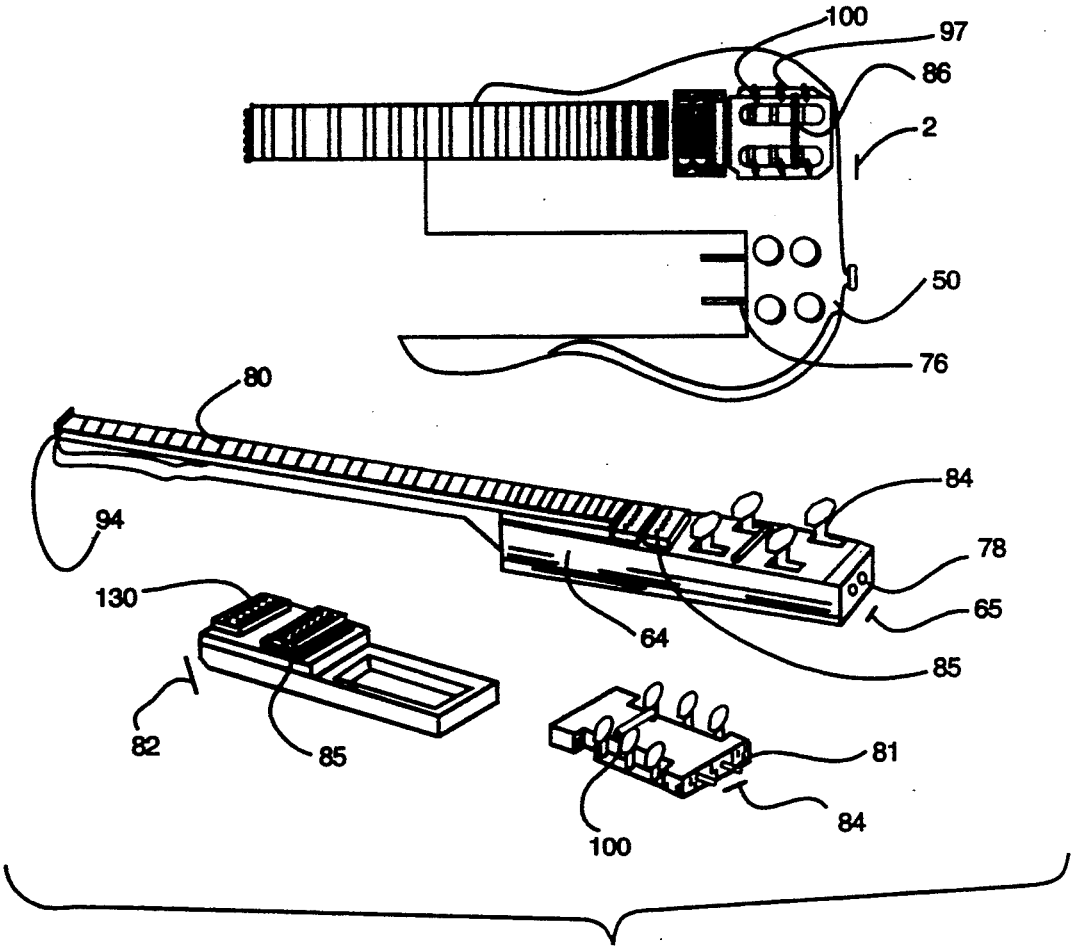
FIG. 8 is a perspective view showing a fingerboard assembly removed from the body and showing a cassette from the fingerboard assembly alongside the fingerboard assembly.

FIG. 8 shows guitar body 2 with its first fingerboard assembly 65 removed from upper body section 50. Connector pin 76 is a standard microphone plug which is adapted to go into microphone socket 78 on fingerboard assembly 65. These plugs provide electrical connections between the microphone pickups 85, located on fingerboard assembly 65, and body 2. There is also a normal detent action in such plugs and sockets. This detent action provides additional securement of the fingerboard to the body.

Figure 9:
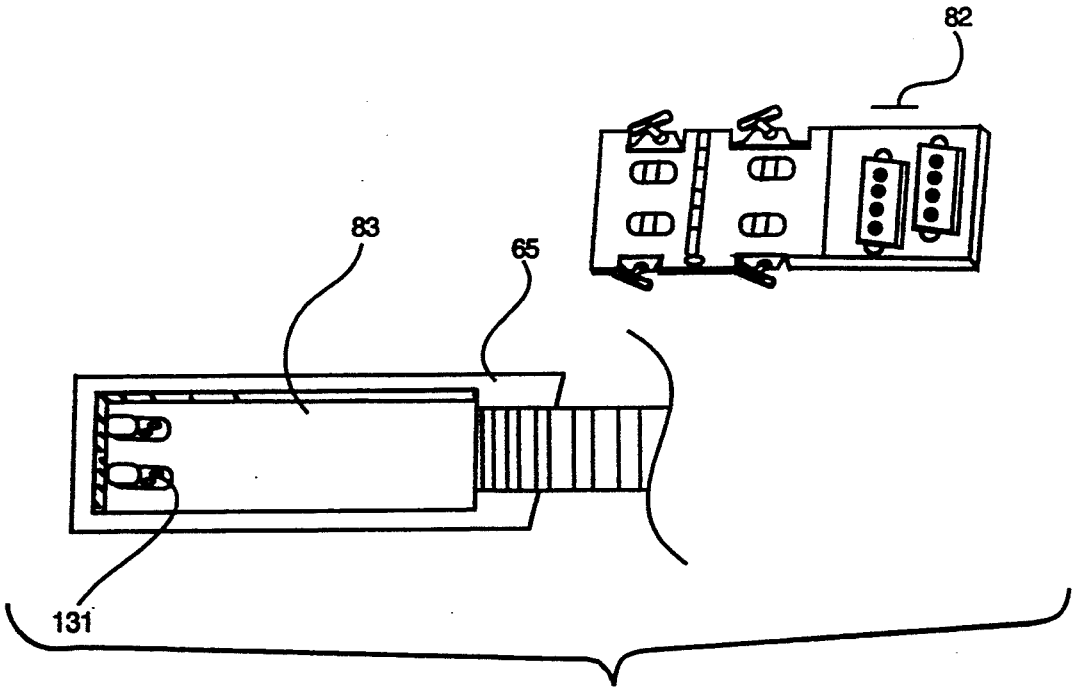
FIG. 9 is a perspective view showing the cassette alongside the cassette niche in the fingerboard assembly.

Strings 80 are tensioned across the length of fingerboard assembly 65 by string tension adjusting assembly 84 and removable headpiece 94- Tension assembly 84 fits onto cassette 82 which comprises microphone pickups 85. These fit together as shown in FIG. 9 and are installed into niche 83 upon fingerboard assembly 65.

Bridge

Figure 10:
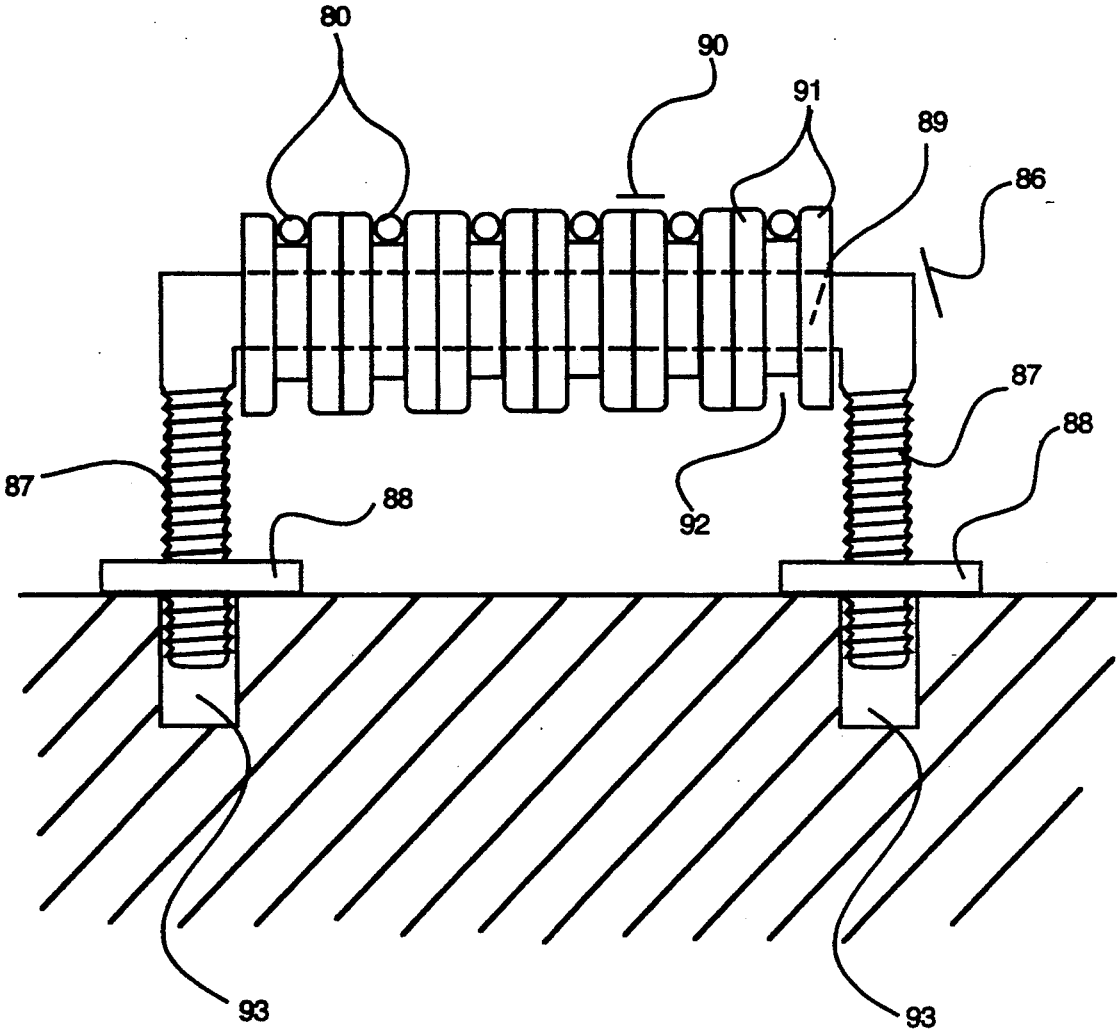
FIG. 10 is an elevation of a bridge of the present invention.

String height is controlled by bridge 86, better shown in FIG. 10. Bridge 86 comprises a pair of threaded mounts 87 onto which are screwed height adjust nuts 88. The mounts 87 are spanned by axle 89. A plurality of spacer rollers are mounted upon axle 89 to provide proper spacing for strings 80. Each roller 90 comprises a pair of shoulders 91 on either side of a groove 92. These shoulders define a pulley-like arrangement so that the strings 80 reside in grooves 92 and can be drawn back and forth there-across with less friction due to the wheel-like nature of their mounting. This is particularly helpful because, in some embodiments, such as in FIG. 8, bridge 86 is located tailward of several of the machines 100 such as machine 97. Thus, strings 80 must make a 180° turn around the bridge 86 to reach machine 97. Absent the bearing effect of spacer roller 90, such a 180° turn would result in excessive friction across the bridge. When machine 97 was tuned, the friction would result in string tension on the machine-ward side of bridge 86 which was unequal to the string tension on the fingerboard side of bridge 86. Over time, as string 80 was plucked, vibration would tend to equalize the tension on the two parts of the string and thus change the string tension on the fingerboard side of bridge 86. This change would result in a variation in tuning so that the tuning would annoyingly tend to change as the instrument was played. Spacer guide rollers 90 tend to minimize this annoying tendency by eliminating most of the friction across the bridge.

Tuning Machines

Figure 11:
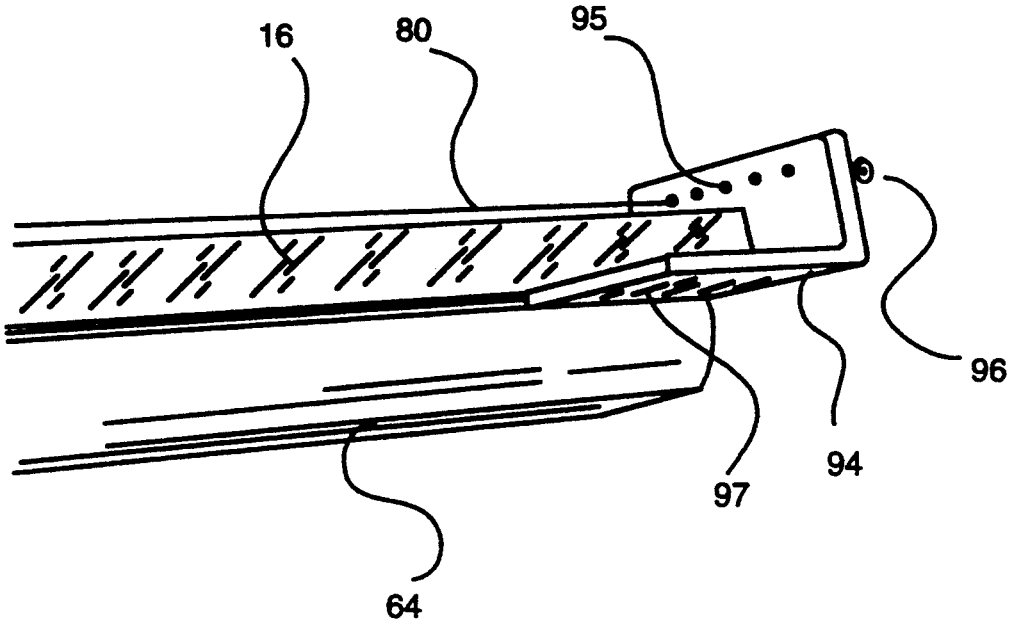
FIG. 11 is a perspective view showing a removable headpiece being slidably mounted to the end of a fingerboard assembly.

Returning to FIG. 8, with machine assembly 84 in place on cassette 82, and installed in niche 83 of fingerboard assembly 65, studs 81 tend to pull against and lock into holes in corresponding locations within niche 83. FIGS. 3 and 8 show removable headpiece 94. Headpiece 94 is also shown in FIG. 11 being slidably mounted upon the end of fingerboard 16. Headpiece 94 comprises an L-shaped aluminum sheet having a plurality of holes 95 through which strings 80 are strung. On the distal side of these holes, the guitar strings are wrapped around thimbles 96 and spliced to themselves by twisting. Stopper thimbles 96 hold the strings in place in headpiece 94. The bottom of the "L" of headpiece 94 is shown being inserted into slot 97 between fingerboards 16 and reinforcing structure 64. Once headpiece 94 is lined up with the fingerboard, and strings 80 are tensioned, the entire arrangement will be locked firmly in place as in FIG. 3. Returning to FIB. 8, the pickup assembly 85, which may be removable for rapid changes of sound characteristics, comprises a plurality of mikes 130. These are wired to contacts on the underside of cassette 82 which contact contacts 131 in niche 83, shown in FIG. 9. Thus, the signal is transmitted from the microphones to the fingerboard assembly 65 and then through socket 78 through plugs 76 into the body 2 of guitar 1.

The flexible nature of this stringed instrument system allows the following options:

- a tuner assembly on the body;
- a tuner assembly on the head; and
- a coarse tuning mechanism at one end and a fine tuning mechanism at the other.

Dampers

Figure 12:
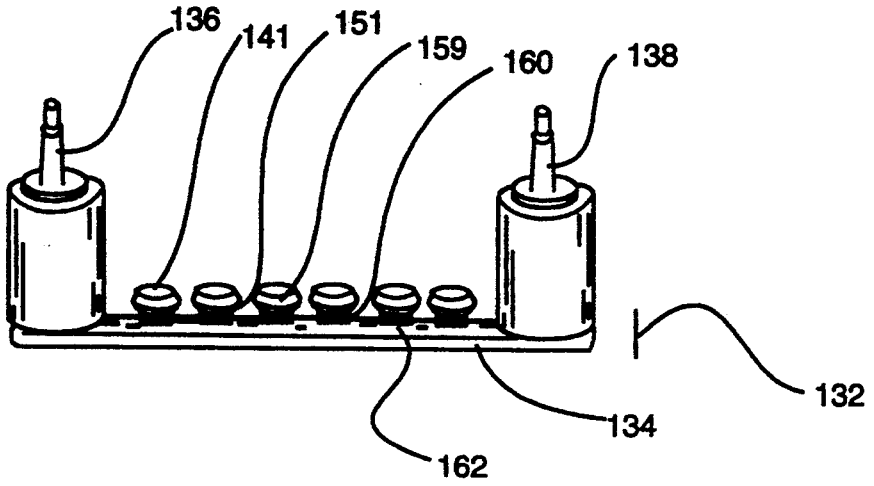
FIG. 12 is a perspective view of a damper assembly of the present invention.
Figure 13:
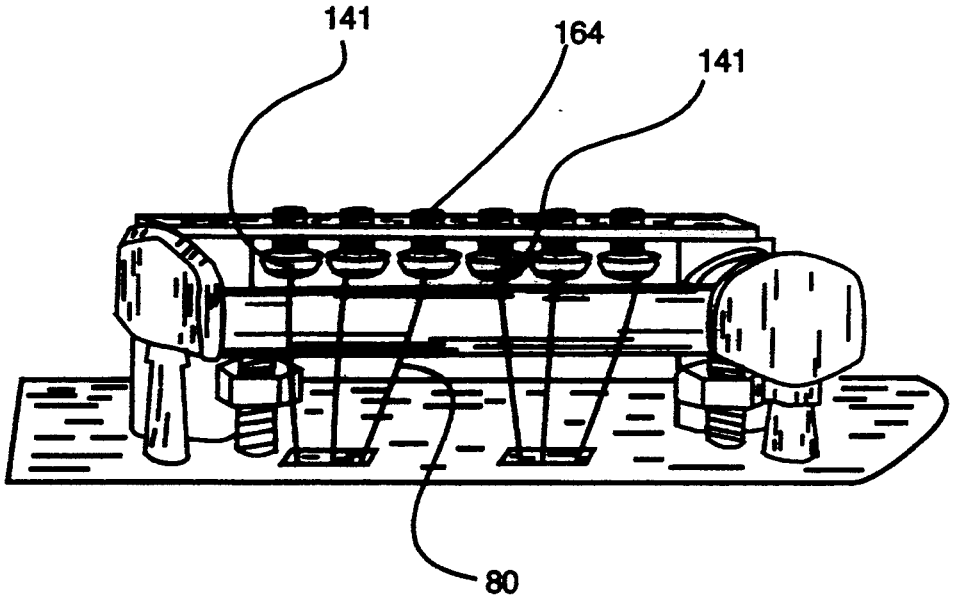
FIG. 13 is a perspective view of such a damper assembly installed upon a guitar of the present invention.

In multi-string embodiments of the present invention, such as twelve-string guitars or twelve-string necks, undesired resonances can occur when some of the strings are actuated, particularly when amplified and broadcast over speakers that are located proximate to the guitar. To eliminate these undesired resonances, a damper mechanism 132 is provided as shown in FIGS. 12 and 13. The damper 132 comprises a span 134 which spans across a pair of mounts 136, 138. In their present embodiment these mounts comprise standard microphone mini-plugs. The inventor contemplates combining this damper assembly with a microphone pickup assembly and using these mini-plugs to transmit the signal from the microphones into the guitar. Damping pads 14 1 are mounted on span 134. Each of these pads are mounted on an adjuster 15l. Each adjuster comprises pad mount 159 upon a screw shaft 160. Each screw shaft is threaded through a threaded hole 162 in span 134. Above span 134 at the end of screw shaft 160 is a slotted screw head 164 [FIG. 13]. Each pad 141 is located over a corresponding guitar string 180 as shown in FIG. 13, which shows the damper mounted upon a guitar. Each screw head 164 is turned until each pad 141 Just barely touches each guitar string 80. Thus, When the guitar strings are not depressed, the damper damps any vibration which may be induced in string 80 through sympathetic vibration. When a finger depresses a guitar string 80 toward the fretboard, it pulls the string away from the precisely adjusted damper pad 141 and allows the string to vibrate freely. An additional benefit of the damper is that it serves as a guard to prevent the player's sleeve from providing unwanted damping.

Piano-type Tuners

Figure 14:
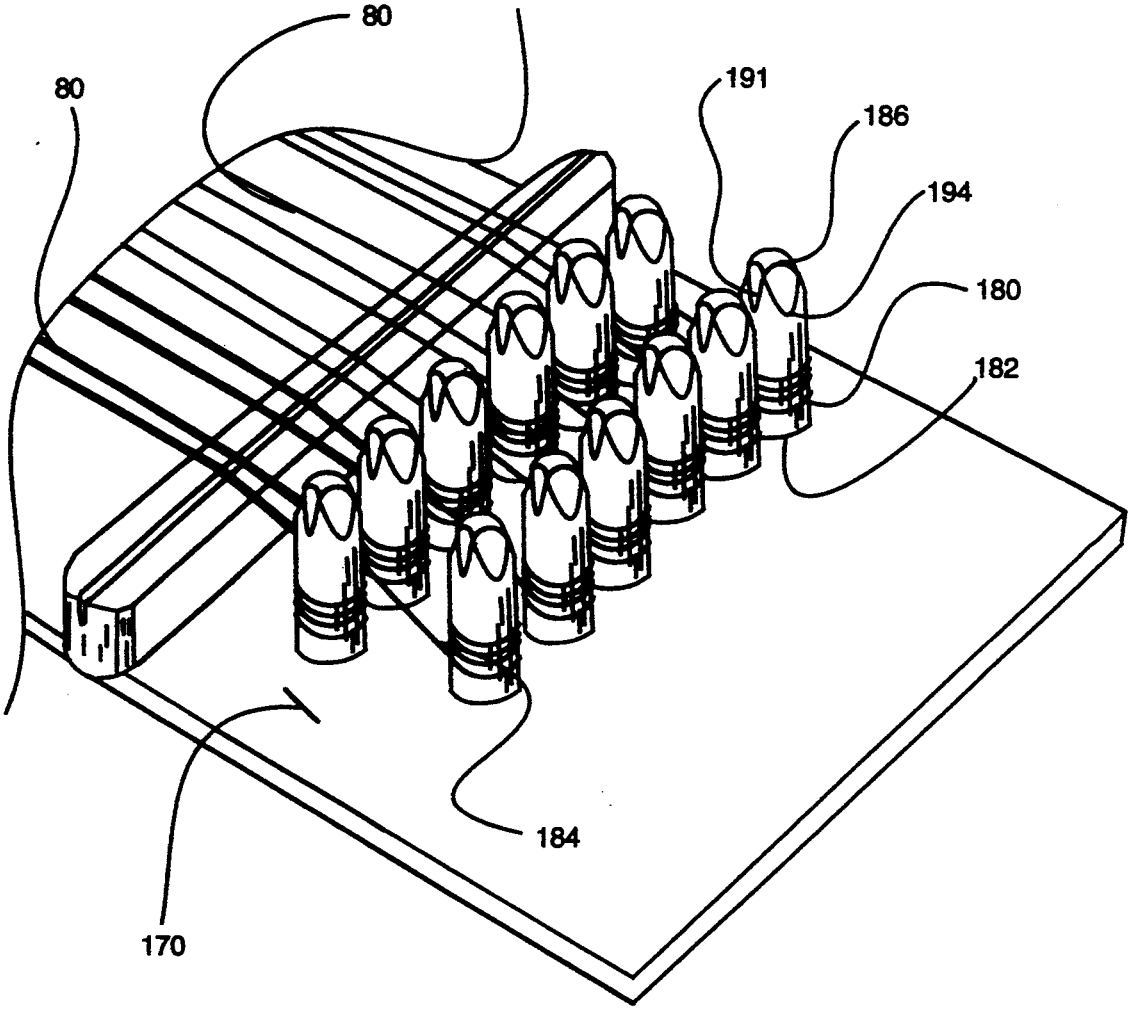
FIG. 14 is a perspective view of an alternative tuning mechanism of the present invention.

Another innovation particularly suited to twelve-string guitars is the tuning system which uses piano-type tuners, as shown in FIG. 14. Each tuner 170 comprises a cylindrical shaft 180 frictionally mounted in a mounting hole 182. Each guitar string 80 is secured to its shaft 180 by being threaded through a mounting hole 184 and wound around shaft 180. Winding is accomplished by fitting a wrench, such as a socket of a piano tuning hammer, over the shaft head 186. The four sides of the shaft head 190–194 are flattened to cooperate with the socket of the wrench which is used to turn shaft 180 in its friction mount hole 182 to wrap string 80 around shaft 180 and pull tension on string 80 until the desired tuning is achieved. Such an arrangement allows for much more compact arrangement of the tuning machines than is possible with the conventional wing-nut and screw-machine arrangement of a standard guitar. Thus, the strings can be much more densely packed and can be much more numerous without the conventional tuning machines. These factors compensate for the slight inconvenience of having to have a tuning wrench handy. A compartment may be provided in the guitar to contain such a wrench for convenient use.

Fingerboard Extensions

Figure 15:
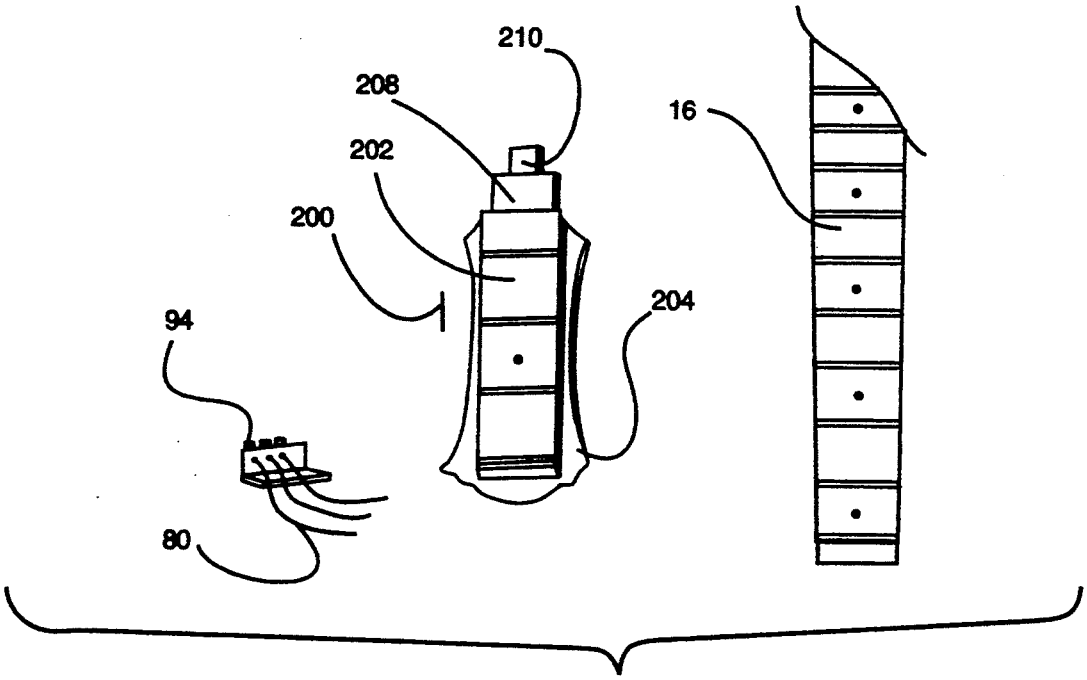
FIG. 15 is a front perspective view of a guitar neck of the present invention with a fretboard extender.
Figure 16:
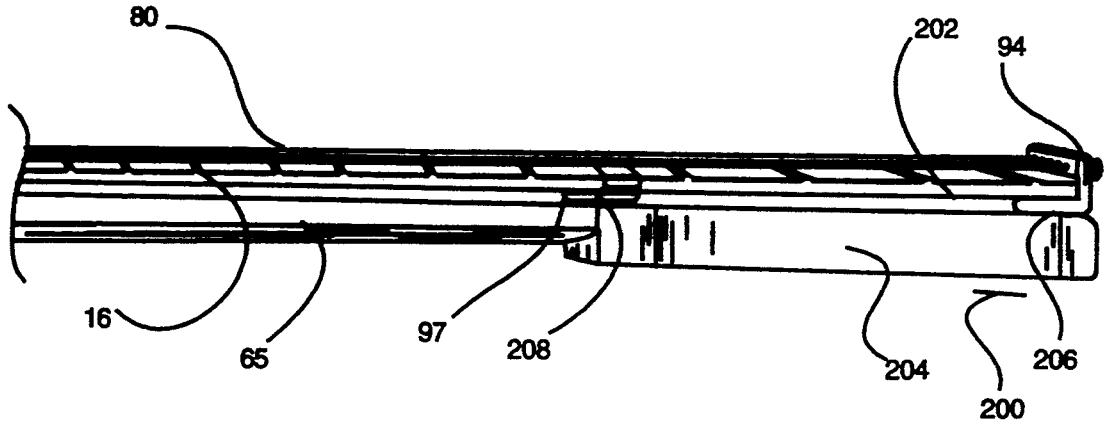
FIG. 16 is a side elevation thereof.

In another embodiment of the present invention, further flexibility can be achieved with or without the removable fingerboard feature. As shown in FIGS. 15 and 16, a fingerboard extension 200 is provided in order to extend the range of a fretboard, whether that fretboard is removable from the body or is fixed to the body. Fingerboard extension 200 comprises fretboard extension 202 and extension reinforcing structure 204. To attach the extension to a fingerboard, the headpiece 94 is removed from fingerboard 16. Tongue 208 of extension 200 is slid into slot 97 which would otherwise house the headpiece 94. A headpiece 94 containing longer strings is then placed in slot 206 between fretboard extension 202 and extension reinforcing structure 204. Rectangular peg 210 may also be provided to fit into a corresponding hole on the end of reinforcing structure 65. This would provide lateral location of the extension and additional strength.

Figure 17:
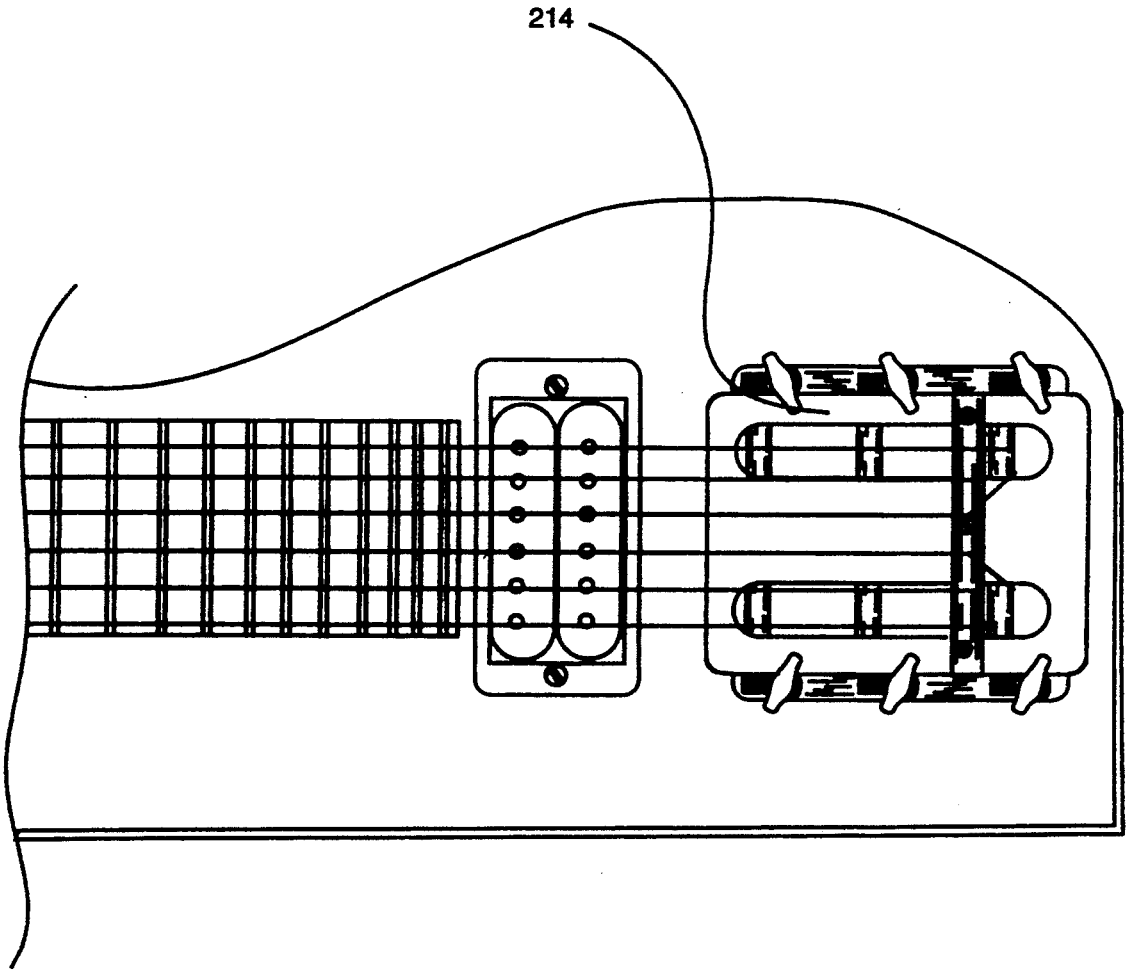
FIG. 17 is a front elevation of a body section with tuning assembly.

Preferably, such extensions would be used in conjunction with a second headpiece 94, a second set of strings 80 and a second tuning machine assembly 214 [see FIG. 17]. Thus, the new set of strings can be installed on the extended fingerboard without rethreading and rewinding of the strings through the headpiece 94 and onto tuning machine assembly 214.

Figure 19:
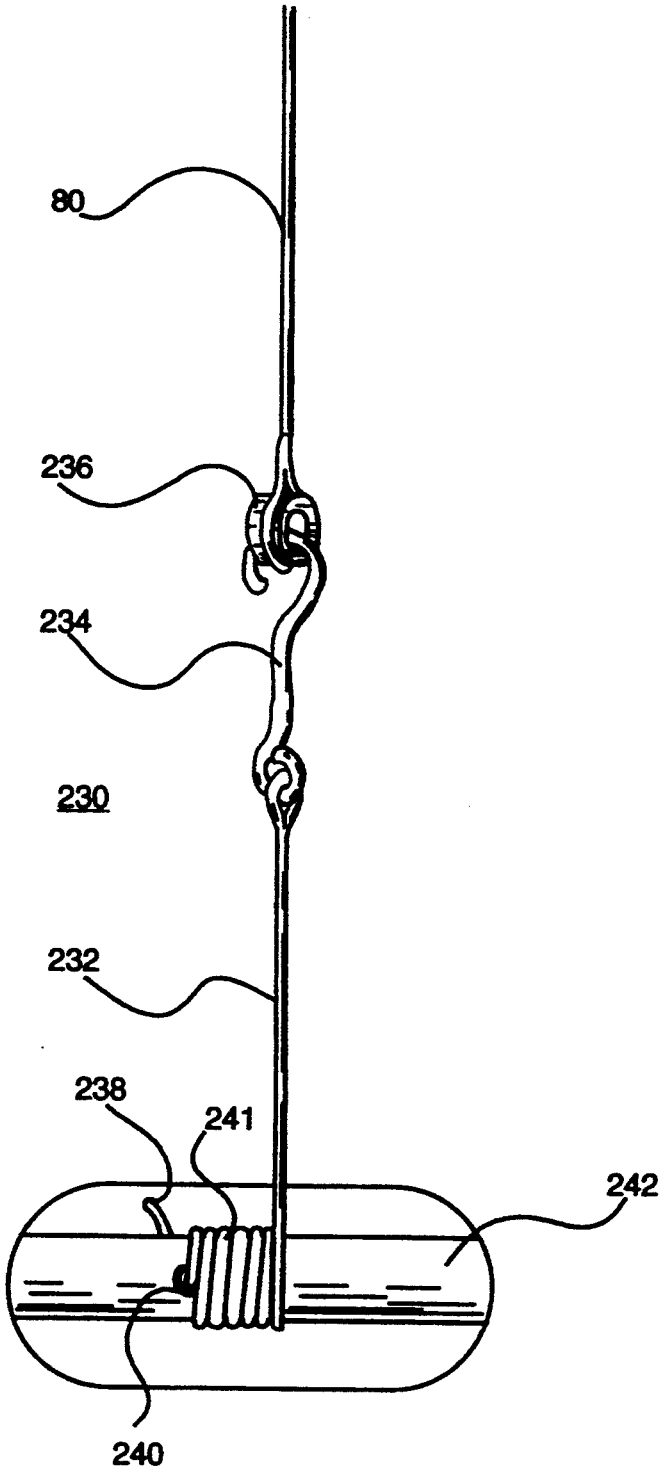
FIG. 19 is an elevation of a string extender.

String Extenders

Where the fingerboard is of such great length that it is not possible to use standard length guitar strings, a string extender, shown in FIG. 19 and generally designated 230, may be provided in order to supply the extra length. The string extender comprises a second guitar string 232 attached to the first guitar string 80. Attachment between the two strings 80 and 232 is accomplished by a hook such as hook 234 which joins the stopper thimble 236 of string 80 to string 232 by means of being hooked through the eye of thimble 236. Free end 238 of second string 232 has been passed through hole 240 in capstan 242 of the tuning mechanism. The tuning mechanism then winds free end 238 in a coil 241 around capstan 242 until the desired tension is achieved.

To install the string extender, hook 234 is threaded through the hole in thimble 236. The free end 238 of string 232 is inserted in hole 240. Then, free end 238 is wound around capstan 242 until the desired tension is achieved.

This arrangement has the added benefit that, when a headpiece or fingerboard extension is to be interchanged, the strings 80 may be detached from the tuning mechanisms by loosening capstan 242 until the hooks 234 can be removed from eyes 236. This arrangement eliminates the necessity to rethread the string through hole 240, and to take up the entire coil 241 which contains the entire slack of the guitar string and extender.

Fastpin on Capo

FIG. 26 shows a cam capo 30 which is eccentricly rotationally mounted on a fastpin 450. Fastpin 450 comprises a hollow cylinder 452 within which shaft 454 is slidably mounted, pinning ball 456 in a hole in cylinder 452. Depressing end 458 of shaft 454 allows ball 456 to recess into recess 450, allowing fastpin 450 to be withdrawn from tension member 46 for easy dismounting of cam capo 30 from fingerboard 20. When end 458 is released, spring 462 drives shaft 454 back, causing taper 464 to drive ball 456 back into the hole in cylinder wall 452. If the fit between a hole in tension member 46 and cylinder 452 is snug, ball 456 will prevent cylinder 452's passage through the hole.

Ambidextrous Guitar

The front-to-back ambidextrous capability of the fingerboard assembly is described above at page 14 and FIG. 7.

Another embodiment of this guitar (FIG. 27) has a fingerboard assembly comprising the fingerboard 16, including a head piece 568 at its headward end with tuners 570, a pickup 571 located on a pickup cassette 572, and a bridge 573 located on a bridge cassette 574. The fingerboard assembly 565 has a centrally located groove on its top and another on its bottom, each of which mates with a centrally located tongue 575 (FIG. 31 ) in either side of body 502. The fingerboard assembly 565 slides into body 502 with the fingerboard assembly's front oriented to either the body's front surface 562 (as shown) or back surface 576.

Body 502 may be symmetrical above and below the fingerboard assembly so that reversal is done without any change in the mating of fingerboard to body 502 in either orientation.

Front surface 562 and back surface 576 may be different colors or styles, so that reversal can serve a stylistic function rather than or in addition to its ambidextrous function.

Electronic controls 578 are located on bridge cassette 574 and are thus always available in either orientation.

Alternatively, as in FIG. 28, body 502 may be asymmetrical so that a fingering cut-out 580 can always be located on the lower portion of the body, and the electronic controls 578A can always be located on the upper part of the body. As shown in FIG. 28, cutout 580 comprises means for accessing an adjacent bodyward portion of the fingerboard assembly by the guitar player's fingers.

In this embodiment, fingerboard assembly 565 is narrow, so as to fully confer the fingering advantage of cutout 580 to both right-handed (FIG. 28) and left-handed (FIG. 29) configurations. Thus, for purposes of ambidextrousness an asymmetrical shaped guitar could be adjusted for left hand or right hand play by sliding the entire fingerboard assembly 565, including pickup and bridge cassette, out turning it over, 180 degrees with respect to the body, and sliding it back into the body.

In the symmetrical multi-colored version a different colored or styled face could be had by performing the same maneuver.

In constructing the neck piece (FIG. 27) the joint between the removable head piece 568 and the neck 565 comprises an aluminum plate 582 in a transverse plane upon the end of the neck, the plate having a T-shaped hole 584 (FIG. 30) adapted to receive a T-shaped insert from head piece 568.

Electrical contacts are made between the tailward edge of the cassette 586 and tailward inner wall 588 of body 502. Generally, as in FIG. 31, there would be four screw contacts 591-4, so that polarity could be achieved in either orientation. Only two of the contacts, 591-4 or 593-4, would be active in either orientation.

In order to identify positive and negative electrical contacts, screw heads 591, 592, 593, 594 can be used as each of the electrical contacts. Positive screw heads 592, 594 would be Phillips head, the negative screw heads 591-3-contacts would be standard slot, thus presenting plus and minus signs to an observer.

As in FIG. 32, each of the screw heads 591-4 go into a respective recess, two-active of which recesses each contain a contact spring 605,606.

I claim:

1. A reversible stringed instrument system comprising:

a body having two broad surfaces comprising a first surface and a second surface opposite the first surface;

a removable fingerboard assembly having means for reversibly slidably mounting said assembly to the body;

said fingerboard assembly having a front surface and a back surface, said mounting means further for locating the back surface of the fingerboard assembly substantially coplanar either to the second surface or to the first surface, said fingerboard assembly thus being reversibly mountable with the fingerboard assembly front surface sequentially locatable to either of the two broad surfaces of the body, each of the two broad surfaces thus being alternatively capable of use as a front surface of the instrument or as a back surface of the instrument.

2. A stringed instrument system according to claim 1 in which the mounting means further comprises:

a longitudinal groove, substantially centered between the fingerboard assembly front surface and the fingerboard assembly back surface, and a tongue substantially centrally located between the body's first surface and the body's second surface said tongue positioned for cooperative engagement with said groove.

3. A stringed instrument system according to claim 2 in which the fingerboard assembly comprises a plurality of cassettes, including a pickup cassette housing, an electronic pickup assembly; and a bridge cassette housing a bridge assembly.

4. System according to claim 1 in which the broad surfaces of the body each have a horizontal axis substantially parallel to the mounting means, and each of said broad surfaces is symmetrical about the horizontal axis, but dissimilar in appearance from a first of the broad surfaces to [a second of the broad surfaces.

5. System according to claim 3 in which the body has a horizontal axis about which axis the body is asymmetrical.

6. System according to claim 5 in which:

the fingerboard assembly has a bodyward portion, and the body comprises a fingering cutout in the body, said cutout comprising means for finger accessing of the bodyward portion of the fingerboard.

7. System according to claim 6 having electronic controls in which the electronic controls are located on the bridge cassette bodyward of the bridge.

8. System according to claim 6 in which the body has:

a top surface and electronic control means, and said electronic control means are located on the top surface of the body.

9. Apparatus according to claim 1 in which electrical contact is made between the fingerboard assembly and the body by a system of contacts, including positive contacts comprising Phillips head screws, and negative contacts comprising slotted head screws;

said screw heads fitting into cylindrical recesses in an opposite member, said recesses which are active containing contact means for electrically contacting the screw heads.

10. System according to claim 1 in which the first surface is a first visual appearance, and the second surface is a second visual appearance.

11. System according to claim 1 further comprising:

a system of contacts in which electrical contact is made between the fingerboard assembly and the body by the system of contacts;

said system of contacts including a positive contact comprising a Phillips head screw, and a negative contact comprising a slotted head screw;

said screws all having heads;

cylindrical recesses in said fingerboard assembly at least some of said screw heads fitting into the cylindrical recesses;

said recesses containing means for electrically contacting the screw heads.

12. A stringed instrument system comprising:

a body having:

a headward edge;

a tailward edge, opposite the headward edge;

an upper edge, between the headward and tailward edges;

a lower edge, opposite the tailward edge;

two broad surfaces between all said edges, including:

a first broad surface, and a second broad surface opposite said first broad surface;

each of the two broad surfaces defining a plane;

a fingerboard assembly extending beyond the headward edge of the body;

the fingerboard assembly comprising a fingerboard;

said fingerboard assembly comprising means for reinforcing the fingerboard, affixed behind and to the fingerboard, the reinforcing means being substantially located between the planes defined by the two broad surfaces of the body;

the reinforcing means comprising:

slide-mount means for removably slidably mounting the fingerboard reversibly to the body, and connector means for electrically connecting the fingerboard assembly to the body, said connector means having a parallel relation to the slide-mount means;

said connector means further having a plurality of screws, including a Phillips head screw and a slotted head screw, the Phillips head being a positive contact and the slotted head being a negative contact;

a plurality of strings in front of the fingerboard;

a head piece located headward of the fingerboard assembly, and affixed to the fingerboard assembly;

said head piece comprising tuning means connected to the strings for tuning the strings;

a pickup cassette removably placed in the reinforcing means of fingerboard assembly;

said pickup cassette comprising means for said pickup cassette's removal from said fingerboard assembly;

said pickup cassette comprising electrical pickup means for sensing string vibration;

a bridge cassette, mounted on the reinforcing means of the fingerboard assembly;

said bridge cassette comprising a bridge mounted thereon;

said bridge cassette comprising means for removal from said fingerboard assembly;

the bridge having guide means for appropriately spacing each string of the plurality of strings;

the strings connected to the bridge cassette; and aluminum reinforcing means between the head piece and the fingerboard assembly for locating the head piece and for reinforcing the fingerboard assembly.

13. A stringed musical instrument comprising:

a fingerboard assembly having a front surface and a back surface;

a plurality of strings attached to said front surface of said fingerboard assembly;

a body having a first surface and a second surface;

means for slidably mounting said fingerboard assembly selectively with either said first or said second surface of the body substantially coplanar to said front or back surface of the fingerboard assembly.

* * * * *